US010485321B2

(12) United States Patent
Byun

(10) Patent No.: US 10,485,321 B2
(45) Date of Patent: Nov. 26, 2019

(54) CASE FOR LIQUID STATE COSMETICS

(71) Applicant: Young-Kwang Byun, Seoul (KR)

(72) Inventor: Young-Kwang Byun, Seoul (KR)

( * ) Notice: Subject to any disclaimer, the term of this patent is extended or adjusted under 35 U.S.C. 154(b) by 0 days.

(21) Appl. No.: 15/958,509

(22) Filed: Apr. 20, 2018

(65) Prior Publication Data

US 2019/0116959 A1 Apr. 25, 2019

(30) Foreign Application Priority Data

Oct. 24, 2017 (KR) ..... 10-2017-0138650

(51) Int. Cl.
*A45D 34/00* (2006.01)

(52) U.S. Cl.
CPC ..... *A45D 34/00* (2013.01); *A45D 2200/055* (2013.01)

(58) Field of Classification Search
CPC ..... A45D 34/00; A45D 2200/055
USPC ..... 222/321.1, 207
See application file for complete search history.

(56) References Cited

U.S. PATENT DOCUMENTS 5,152,434 A * 10/1992 Birmelin ..... B05B 11/3001 222/207
5,306,125 A * 4/1994 Weag ..... B05B 11/0027 222/207
5,518,147 A * 5/1996 Peterson ..... B05B 11/3035 222/153.07
5,664,703 A * 9/1997 Reifenberger ..... B05B 11/0064 222/207
5,819,990 A * 10/1998 Cimentepe ..... B05B 11/0067 222/207

(Continued)

FOREIGN PATENT DOCUMENTS

KR 2008-0092814 A 10/2008
KR 10-0898619 B1 5/2009

(Continued)

OTHER PUBLICATIONS

Non-Final Rejection received for U.S. Appl. No. 15/958,539, dated Jan. 15, 2019, 13 pages.

(Continued)

*Primary Examiner* — Patrick M. Buechner
*Assistant Examiner* — Michael J. Melaragno
(74) *Attorney, Agent, or Firm* — Kaplan Breyer Schwarz, LLP

(57) ABSTRACT

Provided is a case for liquid state cosmetics. The case for liquid state cosmetics includes a case body provided with a content storage part in which the liquid content is stored, a shoulder unit coupled to close an upper portion of the case body and provided with an inflow part having a content inflow hole in a center thereof; a piston unit disposed in the case body to move according to discharge of the content, a pumping unit inserted into the inflow part and connected to the content inflow hole to discharge the content through pumping action due to elasticity, and a button unit elevatably coupled to an upper portion of the shoulder unit and connected to the pumping unit and having an outlet hole, through which the content is discharged, at a center thereof, the button unit operating the pumping unit to discharge the content to the outlet hole by the pumping action of the pumping unit.

11 Claims, 29 Drawing Sheets

(56) References Cited

U.S. PATENT DOCUMENTS

| | | | | |
|---|---|---|---|---|
| 8,881,946 | B2 * | 11/2014 | Lee | A45D 33/02 132/299 |
| 10,010,153 | B2 * | 7/2018 | Kim | A45D 34/00 |
| 10,104,951 | B2 * | 10/2018 | Lee | A45D 33/025 |
| 2001/0017305 | A1 * | 8/2001 | Bonningue | B05B 11/3028 222/207 |
| 2007/0131719 | A1 * | 6/2007 | Masuda | B05B 11/0029 222/256 |
| 2008/0061083 | A1 * | 3/2008 | Masuda | B05B 11/0029 222/256 |
| 2009/0283548 | A1 | 11/2009 | Hummel | |
| 2010/0116849 | A1 | 5/2010 | Lautre | |
| 2012/0024904 | A1 * | 2/2012 | Doulin | B05B 11/3035 222/207 |
| 2012/0305606 | A1 * | 12/2012 | Lee | A45D 33/02 222/256 |
| 2014/0103071 | A1 * | 4/2014 | Park | A45D 34/00 222/207 |
| 2014/0346195 | A1 * | 11/2014 | Doulin | B05B 11/0067 222/207 |
| 2016/0015149 | A1 * | 1/2016 | Kim | A45D 34/00 222/383.1 |
| 2016/0073761 | A1 * | 3/2016 | Lee | A45D 33/025 132/298 |
| 2016/0136666 | A1 * | 5/2016 | Kang | B05B 11/3028 222/182 |
| 2016/0227903 | A1 * | 8/2016 | Kang | A45D 34/00 |
| 2016/0242529 | A1 * | 8/2016 | Oh | A45D 34/00 |
| 2017/0049213 | A1 * | 2/2017 | Kang | A45D 34/00 |
| 2017/0056905 | A1 * | 3/2017 | Lee | B05B 11/3001 |
| 2017/0273437 | A1 * | 9/2017 | Kim | A45D 34/00 |
| 2017/0280852 | A1 * | 10/2017 | Kang | A45D 34/00 |
| 2017/0305642 | A1 * | 10/2017 | Kang | A45D 40/26 |
| 2017/0318938 | A1 * | 11/2017 | Lee | A45D 40/0075 |
| 2017/0347772 | A1 * | 12/2017 | Kang | A45D 34/00 |
| 2018/0085767 | A1 * | 3/2018 | Kang, II | B05B 11/0044 |
| 2018/0116371 | A1 * | 5/2018 | Kim | A45D 34/00 |
| 2018/0140073 | A1 * | 5/2018 | Chang | A45D 40/0075 |
| 2018/0186551 | A1 * | 7/2018 | Lee | A45D 34/042 |
| 2018/0271251 | A1 * | 9/2018 | Yeo | A45D 34/00 |
| 2018/0271255 | A1 * | 9/2018 | Hong | A45D 34/00 |
| 2018/0279741 | A1 * | 10/2018 | Oh | A45D 34/00 |

FOREIGN PATENT DOCUMENTS

| | | | |
|---|---|---|---|
| KR | 20110008182 | U | 8/2011 |
| KR | 20-2012-0003278 | | 5/2012 |
| KR | 20-2012-0003279 | U | 5/2012 |
| KR | 2012-0138869 | A | 12/2012 |
| KR | 10-1367880 | B1 | 2/2014 |
| KR | 10-1378369 | B1 | 3/2014 |
| KR | 2017-0062802 | A | 6/2017 |
| WO | 2017/022996 | A1 | 2/2017 |

OTHER PUBLICATIONS

Office Action dated Nov. 12, 2018 issued in corresponding Korean Patent Application No. 10-2017-0138650.

Extended European Search Report issued in EP Application No. 18176240.0 dated Feb. 5, 2019.

* cited by examiner

CASE FOR LIQUID STATE COSMETICS

CROSS-REFERENCE TO RELATED APPLICATION

This application claims priority to and the benefit of Korean Patent Application No. 10-2017-0138650 filed in the Korean Intellectual Property Office on Oct. 24, 2017, the entire contents of which are incorporated herein by reference.

BACKGROUND OF THE INVENTION

(a) Field of the Invention

The present invention relates to a case for liquid state cosmetics, and more particularly, to a case for liquid state cosmetics, which is capable of being used by discharging liquid content stored in the case by a fixed quantity.

(b) Description of the Related Art

In general, a compact case represents a thing that stores and conveniently transports color cosmetics or white powder, which is used for facial makeup while woman are carrying the case.

Such a compact case is provided in various shapes and accommodates and stores cosmetics or white powder regardless of the shapes. Commonly, in use, a button disposed on a front surface of a case body is pressed to open an outer lid from the case body through a hinge rotation, and then, a cosmetic tool such as a puff or brush, which is accommodated in the case, is coated with the cosmetics and used for the facial make up.

Recently, various attempts have been made to accommodate and discharge liquid content in the compact case. A compact case for accommodating and discharging the liquid content is disclosed in Korean Utility Model Registration No. 20-0461424.

According to Korean Utility Model Registration No. 20-0461424, a compact case constituted by an upper case and a lower case and provided with a casing accommodating a contact includes a cylinder fixedly installed inside the lower casing and extending downward from an edge to provide an annular outer wall, wherein a recess part is defined at a center so as to be concentrically disposed with respect to the outer wall, an opening is defined in a lower portion of the recess part, and the opening communicates with an inner space of the outer wall, a plate spaced upward from the cylinder, having a discharge hole, through which the content is discharged, at a center and a through-hole in one side, and an annular downward extension wall on the periphery of the discharge hole, a piston support, in which a hollow rod extends upward at the center in the recess part of the cylinder, a plurality of holes are defined in a circumferential surface of the rod to pass through the inside and the outside of the rod, and a flange is disposed on a lower end thereof, an inner piston installed between the rod of the piston support and the recess part of the cylinder and vertically elevated, an airless pump provided with a protrusion that protrudes upward to seal the discharge hole of the plate at the center, having an opening defined around the protrusion so that the content introduced through the hollow of the piston support passes through the opening, and including a stem having an annular trench having a concentric circle with the protrusion to guide the downward extension wall of the plate, a case piston vertically descending along an inner circumferential surface of an outer wall of the cylinder and coming into contact with an upper portion of the inner case when the content is completely consumed, an auxiliary button installed to be seated on the stem below the plate and having a downwardly inclined part having elasticity in one direction, and a button unit including a main button seated on an upper portion of the auxiliary button and having one side through which the protrusion is exposed to the through-hole of the plate.

However, in the utility model, an airless pump is provided to discharge the liquid content. Thus, since the pumping operation is performed through the airless pump having a complicated structure, an assembling time for installing the airless pump may increase, and also, the number of components may increase to increase manufacturing costs.

Also, the inner position installed between the rod of the piston support and the recess part of the cylinder may be vertically elevated to open and close the discharge hole. Thus, during the decompression vacuum test, the inner piston may ascend at a relatively low pressure, for example, about 200 bars to open and close the discharge hole, thereby causing leakage of the content.

Also, when the button unit is pushed, since the discharge hole is suddenly opened in a state in which an internal pressure is applied to the airless pump, i.e., the internal pressure of the airless pump is not removed, the content may be not be smoothly discharged by a fixed quantity, but be sharply discharged.

SUMMARY OF THE INVENTION

A technical object to be achieved by the present invention is to provide a case for liquid state cosmetics, in which the number of components is reduced to be simplified in structure and to reduce manufacturing costs.

A technical object to be achieved by the present invention is to provide a case for liquid state cosmetics, in which leakage of a content is prevented during a decompression vacuum test.

A technical object to be achieved by the present invention is to provide a case for liquid state cosmetics, in which a content accommodated in the case is smoothly discharged by a fixed quantity when a button is pushed.

To achieve the technical object, a case for liquid state cosmetics according to a preferred embodiment of the present invention includes: a case body provided with a content storage part in which the liquid content is stored; a shoulder unit coupled to close an upper portion of the case body and provided with an inflow part having a content inflow hole in a center thereof; a piston unit disposed in the case body to move according to discharge of the content; a pumping unit inserted into the inflow part and connected to the content inflow hole to discharge the content through pumping action due to elasticity; and a button unit elevatably coupled to an upper portion of the shoulder unit and connected to the pumping unit and having an outlet hole, through which the content is discharged, at a center thereof, the button unit operating the pumping unit to discharge the content to the outlet hole by the pumping action of the pumping unit.

The pumping unit may include: a pumping member which is made of an elastic material so that the content is discharged through the pumping action such as compression and expansion due to the elasticity and through which a content moving passage connected to the content inflow hole passes through the inside thereof;

a valve member provided in a lower portion of the pumping member to open a lower side of the content moving passage communicating with the content inflow hole; a nozzle member inserted into an upper portion of the pumping member to open and close an upper side of the content moving passage while coming into contact and non-contact with the pumping member when the pumping member is elastically deformed, thereby discharging the content; and a pumping cap disposed below the button unit and coupled to the upper portion of the pumping member and having a discharge hole connected to a nozzle hole of the nozzle member at a center thereof.

The pumping member may include: a valve mounting part inserted into and coupled to a content inflow hole of the shoulder unit and provided with the valve member therein; an elastic pumping part extending upward from the valve mounting part and elastically deformed when pushing and pushing-releasing operation of the button unit are performed to perform pumping action for pumping the content within the pumping member upward; a nozzle insertion part which extends upward from the elastic pumping part and is coupled to a lower portion of the pumping cap and in which the nozzle member is inserted therein; and a bellows part having a bellow shape at a center in a longitudinal direction of the nozzle insertion part and compressed and expanded in the longitudinal direction of the nozzle insertion part when the pushing and pushing-releasing operation of the button unit are performed to perform elastic action.

The pumping member may further include: an undercut part stepped so that a lower inner diameter thereof is more expanded than an upper inner diameter thereof on an inner circumferential surface of the nozzle insertion part, wherein, in the state in which the nozzle member is inserted into the nozzle insertion part, a flange part protruding outward from a lower end of the nozzle member may be closely attached to and supported by the undercut part, when the button unit is pushed downward, the bellows part may be compressed downward by the pumping cap to allow the nozzle member to descend so that the close attachment of the flange part to the undercut part is released to open the undercut part and thereby to discharge the content, and when the button unit returns upward, the bellows part may be expanded upward to allow the nozzle member to ascend so that the flange part is closely attached to the undercut part to seal the undercut part and thereby to block the discharge of the content.

The undercut part may be provided as a stepped groove having an inner diameter corresponding to an outer diameter of the flange part on an inner circumferential surface of a connection portion between an upper end of the elastic pumping part and a lower end of the nozzle insertion part.

The elastic pumping part may be configured to connect the valve mounting part to the nozzle insertion part under the undercut part and has a tapered circular tube shape of which a diameter gradually decreases upward, and when the button unit is pushed downward to compress the bellows part downward, the elastic pumping part may be elastically deformed inward in a radius direction of the pumping member to perform pumping for discharging the content within the pumping member upward through the opened undercut part.

The bellows part may serve as a spring while being elastically deformed through the compression and expansion in only the longitudinal direction of the pumping member without being elastically deformed to the inside and outside in the radius direction of the pumping member, and when a decompression vacuum test is performed on the case for the liquid state cosmetics, the undercut part may be prevented from being opened by a pressure within the pumping member to prevent the content from leaking through the undercut part.

The nozzle member may include: a nozzle body inserted into and coupled to a nozzle fixing tube protruding from a lower portion of the pumping cap and having a nozzle hole therein and a nozzle inflow hole connected to the nozzle hole to introduce the content into the nozzle hole in a side portion thereof; an inflow guide piece radially protruding from an outer circumferential surface of the nozzle body to provide a content inflow path between the nozzle fixing tube and the nozzle body and thereby to guide the content into the nozzle inflow hole; and a flange part protruding in an annular shape from a lower end of the nozzle body, having an outer diameter corresponding to an inner diameter of the undercut part, and inserted into the nozzle insertion part so as to be closely attached to and supported by the undercut part.

The pumping cap may include: a cap body provided in a hollow tube shape at a lower center of the button unit, inserted into and coupled to a button stem part fitted into the inflow part, and having a discharge hole connecting the nozzle hole of the nozzle body to the outlet hole of the button unit at a center thereof; and a nozzle fixing tube which protrudes from a lower portion of the cap body and are inserted into and coupled to the inside of an upper end of the pumping member and in which the nozzle body is inserted into and fixed.

The pumping cap may further include: a decompression support extending to protrude downward from a lower portion of the cap body at a predetermined distance with respect to an outer circumferential surface of the nozzle fixing tube and supporting an outer circumferential surface of the nozzle insertion part inserted into and coupled to the outside of the nozzle fixing tube, wherein the decompression support may support the outside of the nozzle insertion part on which the undercut part is disposed when a decompression vacuum test is performed on the case for the liquid state cosmetics to prevent the undercut part from being opened by a pressure within the pumping member and thereby to prevent the content from leaking through the undercut part.

The decompression support may extend up to a connection portion between an upper end of the elastic pumping part and a lower end of the nozzle insertion part so as to be disposed corresponding to the undercut part.

The valve member may be integrated with the pumping member.

The valve member may include: a check valve which extends to the inside of the valve mounting part to form an upward cone shape and in which a slit hole is defined in an upper end thereof so that the slit hole is spread or closed by a pressure to open and close the content moving passage, wherein, when the button unit is pushed downward, the slit hole may be closed by the pressure within the pumping member to seal the check valve, and the bellows part may be compressed downward after the check valve is sealed first to allow the nozzle member to descend so that the close attachment of the flange part to the undercut part is released to open the undercut part and thereby to discharge the content within the pumping member, and when the button unit returns upward, the bellows part may be expanded upward to allow the nozzle member to ascend so that the flange part is closely attached to the undercut part to seal the undercut part and thereby to block the discharge of the content, and the slit hole may be opened by the pressure within the case body after the undercut part is closed first to open the check valve and thereby to fill the content into the pumping member.

The valve member may include: a disk valve in which a disk plate is disposed inside the valve mounting part, a plurality of valve holes are defined between elastic connection pieces connecting the disk plate to the valve mounting part, and the disk plate ascends and descends by elastic deformation of the elastic connection pieces to open and close the content moving passage within the valve mounting part, wherein, when the button unit is pushed downward, the disk plate may descend by the pressure within the pumping member to seal the disk valve, and the bellows part may be compressed downward after the disk valve is sealed first to allow the nozzle member to descend so that the close attachment of the flange part to the undercut part is released to open the undercut part and thereby to discharge the content within the pumping member, and when the button unit returns upward, the bellows part may be expanded upward to allow the nozzle member to ascend so that the flange part is closely attached to the undercut part to seal the undercut part and thereby to block the discharge of the content, and the disk plate may ascend by the pressure within the case body after the undercut part is closed first to open the disk valve and thereby to fill the content into the pumping member.

A case for liquid state cosmetics according to the present invention includes: a case body provided with a content storage part in which the liquid content is stored; a shoulder unit coupled to close an upper portion of the case body and provided with an inflow part having a content inflow hole in a center thereof; a piston unit disposed in the case body to move according to discharge of the content; a pumping unit inserted into the inflow part and connected to the content inflow hole to discharge the content through pumping action due to elasticity; and a button unit elevatably coupled to an upper portion of the shoulder unit and connected to the pumping unit and having an outlet hole, through which the content is discharged, at a center thereof, the button unit operating the pumping unit to discharge the content to the outlet hole by the pumping action of the pumping unit, wherein the pumping unit includes: a pumping member which is made of an elastic material so that the content is discharged through the pumping action such as compression and expansion due to the elasticity and through which a content moving passage connected to the content inflow hole passes through the inside thereof; a valve member integrated with the pumping member to open a lower side of the content moving passage communicating with the content inflow hole; a nozzle member inserted into an upper portion of the pumping member to open and close an upper side of the content moving passage while coming into contact and non-contact with the pumping member when the pumping member is elastically deformed, thereby discharging the content; and a pumping cap disposed below the button unit and coupled to the upper portion of the pumping member and having a discharge hole connected to a nozzle hole of the nozzle member at a center thereof.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A case for liquid state cosmetics according to preferred embodiments of the present invention will be described below in detail with reference to the accompanying drawings.

For reference, detailed descriptions related to well-known functions or configurations will be ruled out in order not to unnecessarily obscure subject matters of the present invention.

Figure 1:
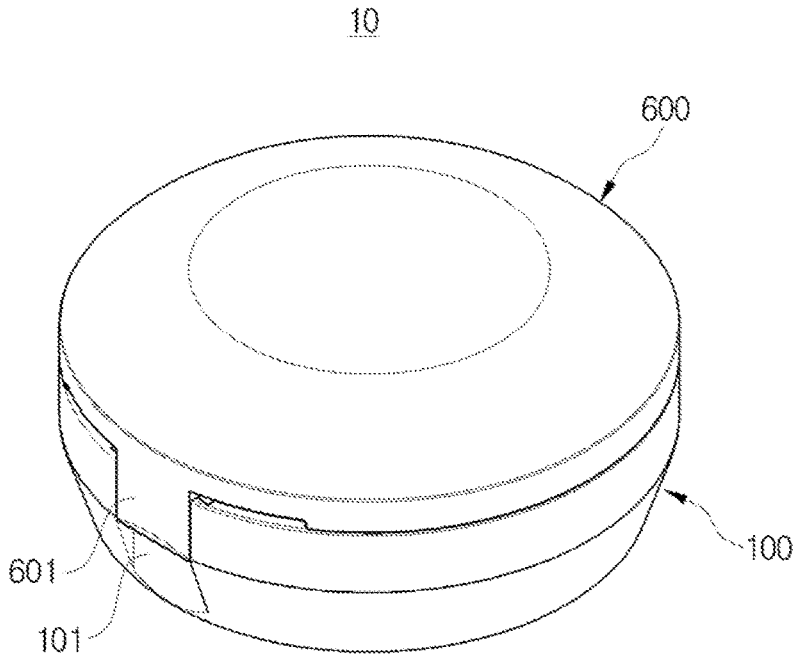
FIG. 1 is a perspective view of a case for liquid state cosmetics according to an embodiment of the present invention.
Figure 2:
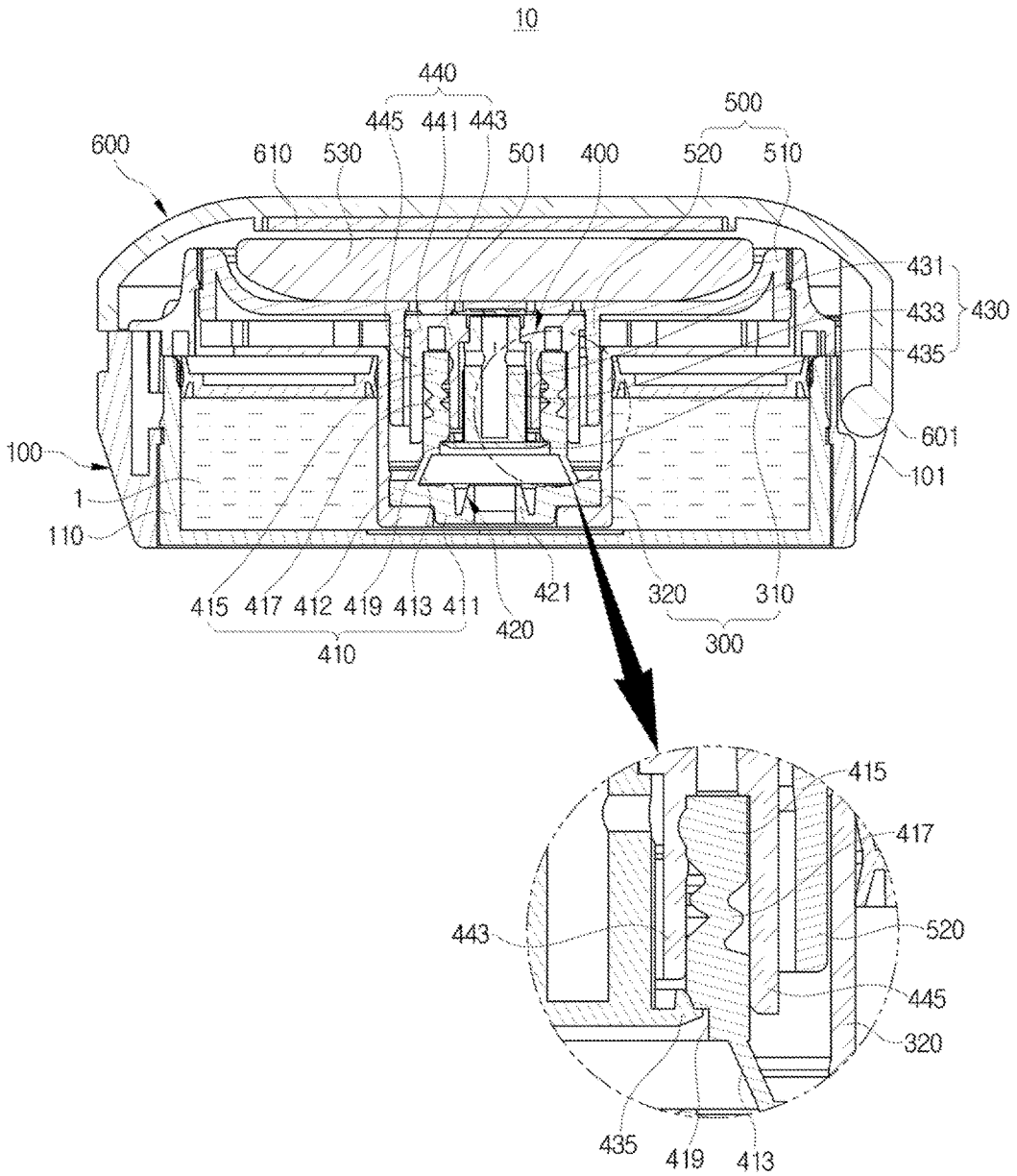
FIG. 2 is a longitudinal cross-sectional view of the case for the liquid state cosmetics according to an embodiment of the present invention.
Figure 3:
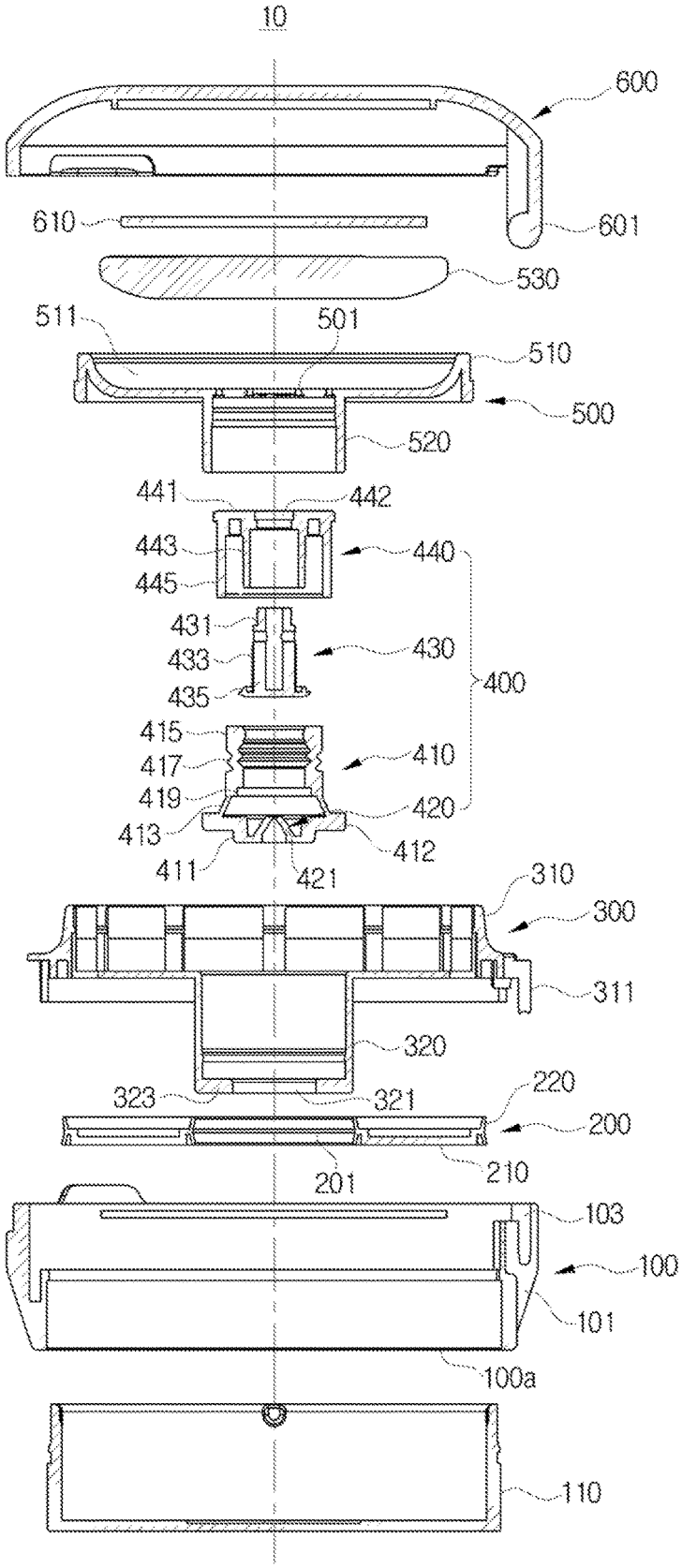
FIG. 3 is an exploded view of FIG. 2.

FIG. 1 is a perspective view of a case for liquid state cosmetics according to an embodiment of the present invention, FIG. 2 is a longitudinal cross-sectional view of the case for the liquid state cosmetics according to an embodiment of the present invention, and FIG. 3 is an exploded view of FIG. 2.

As illustrated in FIGS. 1 to 3, a case 10 for liquid state cosmetics according to an embodiment of the present invention may include a case body 100, a piston unit 200, a shoulder unit 300, a pumping unit 400, a button unit 500, and a case cap 600.

The case 10 for the liquid state cosmetics may have an overall outer appearance in the form of a general compact case.

The case body 100 has a hollow circular case shape having an opened upper portion. A liquid cosmetic content 1 is filled into a content storage part 110 detachably inserted and coupled to a lower opening surface 100*a* of the case body 100.

The piston unit 200 is slidably inserted into the case body 100 to move downward when a pumping unit that will be described later operates, thereby pressing the content 1 so that the content 1 is smoothly discharged to an inflow hole 321 of the shoulder unit 300.

Also, the piston unit 200 may have a circular plate shape and include a pressing part 210 moving downward within the content storage part 10 of the case body 100 to push the content 1 and a contact part 20 disposed on an edge of the pressing part 210 to come into slidable contact with an inner circumferential surface of the case body 100.

The contact part 220 may have a shape of which a central portion is more recessed toward a center of the pressing part 210 than both ends thereof.

Thus, the central portion of the contact part 220 may do not come into contact with an inner circumferential surface of the case body 100, but only both the ends of the contact part 220 may come into slidable contact with the inner circumferential surface of the case body 100.

Also, a piston hole 201 is defined in a central portion of the piston unit 200, and the inflow part 320 of the shoulder unit 300 is inserted into the piston hole 201 so that the piston unit 200 is guided by the inflow part 320 to linearly move downward.

The shoulder unit 300 is fitted into and coupled to the inside of an upper end of the case body 100 to close the upper portion of the content storage part 110.

The shoulder unit 300 may include a shoulder body 310 and the inflow part 320.

The shoulder unit 300 has a circular plate shape to cover an upper opening portion of the content storage part 110, and a coupling groove is defined in a lower inner circumferential surface of the shoulder body 310 so that the upper end of the content storage part 100 is inserted into and coupled to the coupling groove.

Also, a fixing protrusion 311 is bent downward from one side of a side surface of the shoulder body 310 and fitted into and fixed to the fixing groove 103 defined in the case body 100.

The inflow part 320 has a hollow circular tube shape protruding from a lower center of the shoulder body 310, and the content inflow hole 321 communicating with the content storage part 110 of the case body 100 is defined in a lower central portion of the inflow part 320.

Also, a hook protrusion 323 outside the content inflow hole 321 is disposed on a lower end of the inflow part 320. Thus, a hook projection 412 of a pumping member 410 that will be described later may be supported by the hook protrusion 323.

Also, the inflow part 320 is inserted to pass through the piston hole 201 of the piston unit 200.

The pumping unit 400 is inserted into the inflow part 320 of the shoulder unit 300 and connected to the content inflow hole 321 to discharge the content 1 through pumping action due to elasticity.

The pumping unit 400 may include a pumping member 410, a valve member 420, a nozzle member 430, and a pumping cap 440.

The pumping unit 400 will be described below in detail with reference to FIGS. 4 to 16.

The button unit 500 is elevatably coupled to an upper portion of the shoulder unit 300 and connected to the pumping unit 400. A plurality of outlet holes 501 through which the content 1 is discharged are defined in a center of the button unit 500. Thus, the button unit 500 operates the pumping unit 400 so that the content 1 is discharged to the outlet holes 501 by the pumping action of the pumping unit 400.

The button unit 500 may include a button body 510 and a button stem part 520.

The button body 510 has a circular plate shape. The button body 510 is coupled to be vertically movable in a state in which an outer surface of the button body 510 is inserted into an inner surface of the shoulder unit 300, and the pumping action of the pumping unit 400 may be realized through vertical pushing and pushing-releasing operations of the button body 510.

The plurality of outlet holes 501 through which the content 1 is discharged are defined in the center of the button body 510.

Here, the outlet holes 501 communicate with the button stem part 520 that will be described later.

Also, a recess part 511 may be defined in a top surface of the button body 510, and thus, a cosmetic puff 530 may be seated into the recess part 511.

The button stem part 520 is provided in a hollow tube shape at a lower end of the button body 510 and inserted into and coupled to the inflow part 320 of the shoulder unit 300.

The pumping cap 440 of the pumping unit 400 is inserted into and coupled to the button stem part 520.

The case cap 600 has a circular case shape and vertically movably coupled to the case body 100 to cover the button unit 500.

A hinge projection 601 is disposed on one side of a side surface of the case cap 600 and vertically movably coupled to a hinge coupling part 101 disposed on the case body 100.

Also, a mirror 610 may be attached on an inner bottom surface of the case cap 600.

Figure 4:
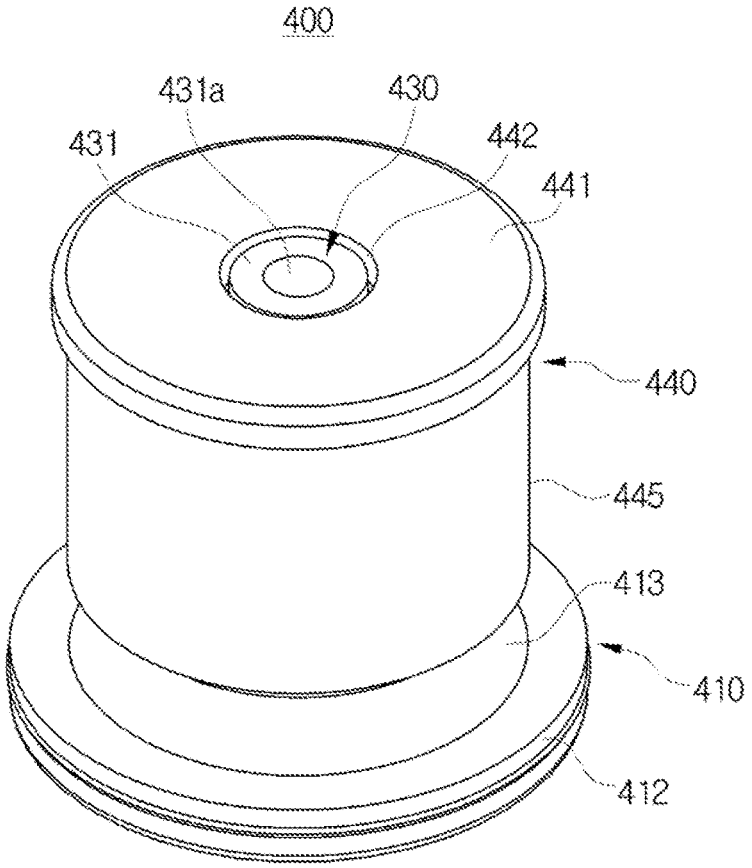
FIG. 4 is a perspective view illustrating a pumping unit of a case for the liquid state cosmetics according to an embodiment of the present invention.
Figure 5:
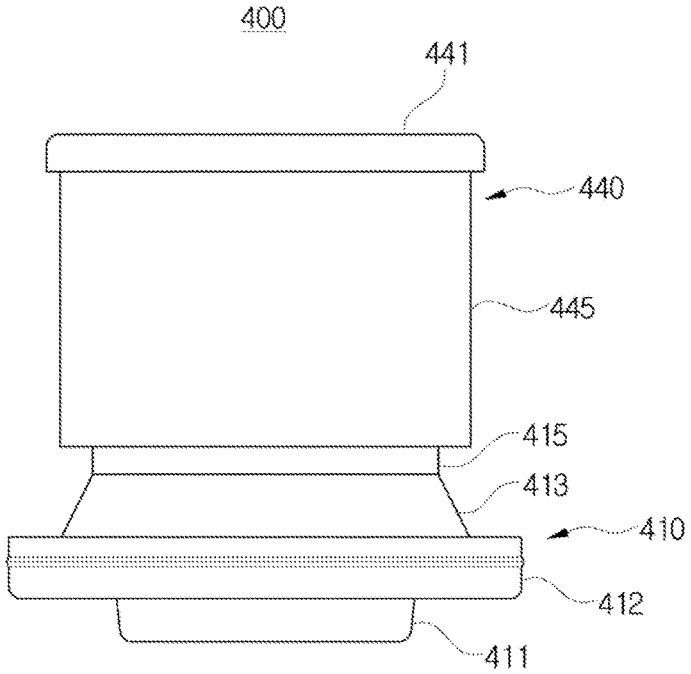
FIG. 5 is a front view of FIG. 4.
Figure 6:
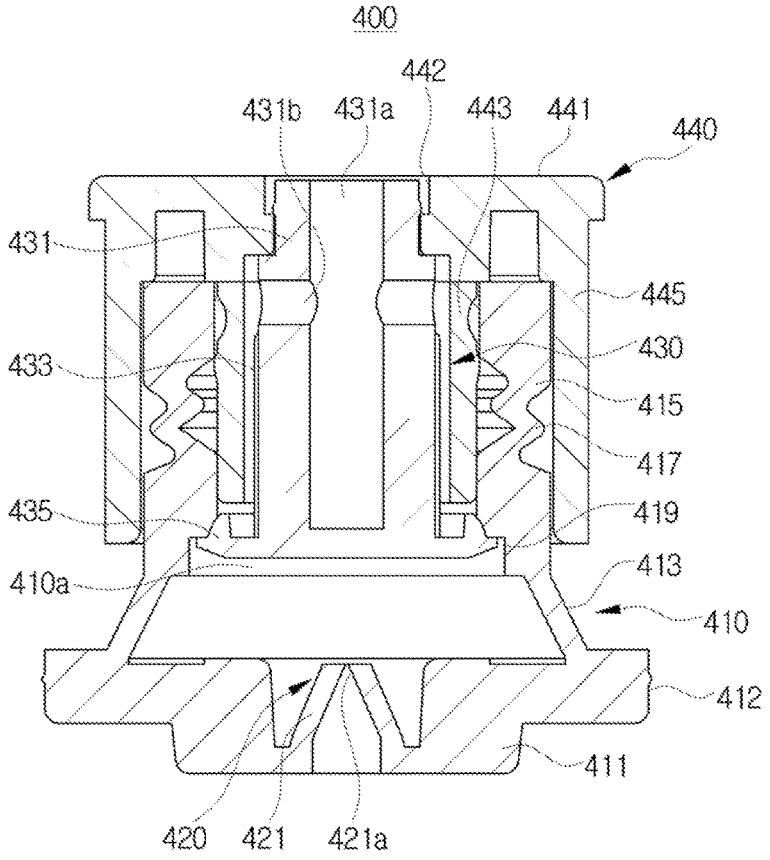
FIG. 6 is a longitudinal cross-sectional view of FIG. 4.

FIG. 4 is a perspective view illustrating the pumping unit of the case for the liquid state cosmetics according to an embodiment of the present invention, FIG. 5 is a front view of FIG. 4, and FIG. 6 is a longitudinal cross-sectional view of FIG. 4.

As illustrated in FIGS. 4 to 6, the pumping unit 400 of the case 10 of the liquid state cosmetics according to an embodiment of the present invention may include the pumping member 410, the valve member 420, the nozzle member 430, and the pumping cap 440.

The pumping member 410 is made of an elastic material so that the content 1 is discharged through the pumping action such as compression and expansion due to the elasticity, and a content moving passage (see reference numeral 410*a* of FIG. 10) connected to the content inflow hole 321 of the shoulder unit 300 passes through the inside of the pumping member 410.

The pumping member 410 may include a valve mounting part 411, an elastic pumping part 413, a nozzle insertion part 415, a bellows part 417, and an undercut part 419.

The pumping member 410 may be made of an elastic material, e.g., a synthetic resin material having elasticity, and thus, the existing spring component may be omitted.

Thus, the number of components of the pumping unit 400 may be reduced to reduce manufacturing costs.

In addition, since the pumping action is performed using the elastic synthetic resin instead of the existing spring made of the metal material, the spring made of the metal material may not be used to prevent the content from being deteriorated due to corrosion of the spring.

The valve member 420 is disposed below the pumping member 410 to open and close the content moving passage 410*a* communicating with the content inflow hole 321.

In addition, the valve member 420 is made of the same elastic material as the pumping member and is integrated with the pumping member 410.

In this embodiment, the valve member 420 is provided as a check valve 421.

The pumping member 410 and the valve member 420 will be described in detail with reference to FIGS. 7 to 10.

The nozzle member 430 is inserted into an upper portion of the pumping member 410, and an upper end of the nozzle member 430 is fitted into and fixed to the discharge hole 442 of the pumping cap 440. When the pumping member 410 is elastically deformed, the nozzle member may come into contact or non-contact with the pumping member 410 and open and close the upper side of the content moving passage 410*a*, and a nozzle hole (see reference numeral 431*a* of FIG. 13) through which the content 1 is discharged is defined in the nozzle member 430.

The nozzle member 430 may include a nozzle body 431, an inflow guide piece 433, and a flange part 435.

The nozzle member 430 will be described below in detail with reference to FIGS. 11 to 13.

The pumping cap 440 is disposed below the button unit 500 and coupled to the upper portion of the pumping member 410. A discharge hole 442 connected to the nozzle hole 431*a* of the nozzle member 430 is defined in a center of the pumping cap 440.

The pumping cap 440 may include a cap body 441, a nozzle fixing tube 443, and a decompression support 445.

The pumping cap 440 will be described below in detail with reference to FIGS. 14 to 16.

Figure 7:
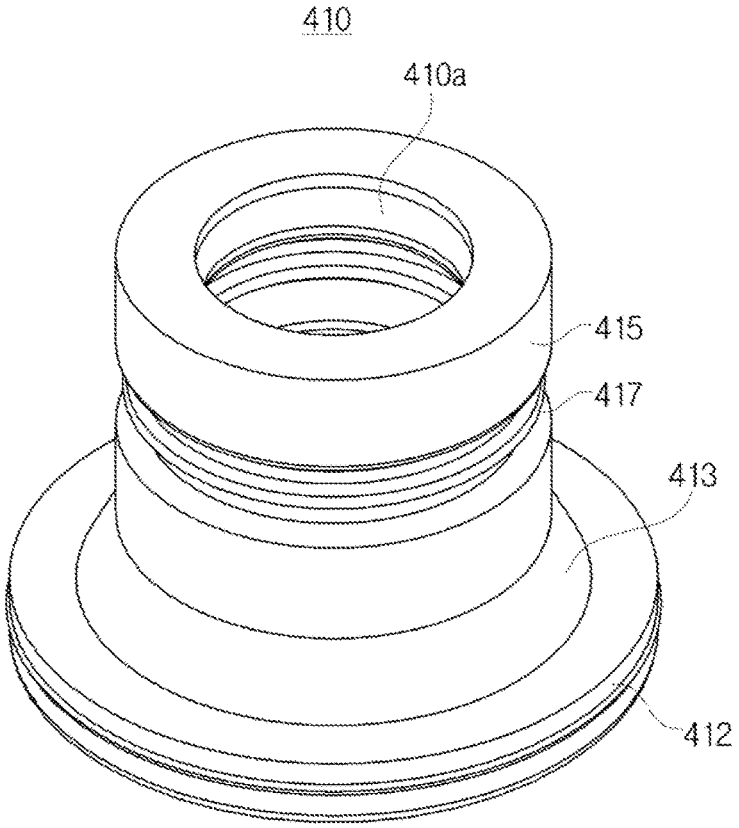
FIG. 7 is a perspective view illustrating a pumping member and a valve member of a pumping unit.
Figure 8:
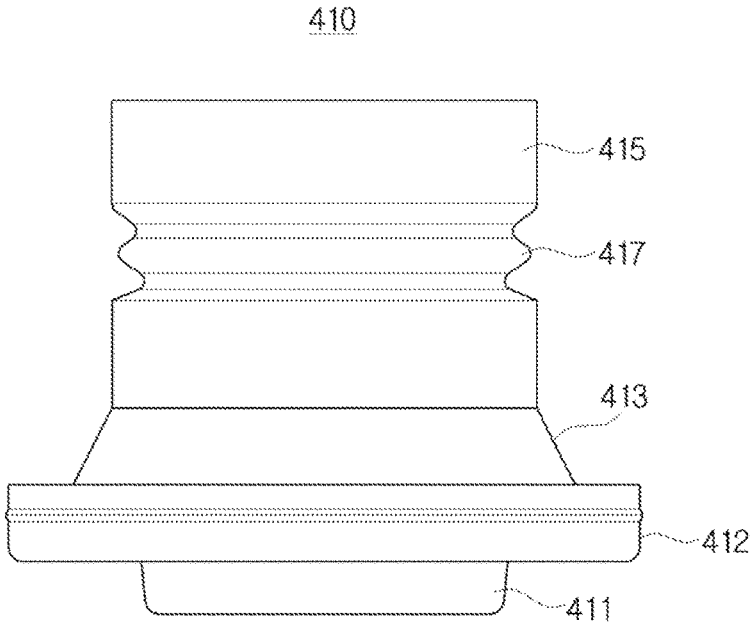
FIG. 8 is a front view of FIG. 7.
Figure 9:
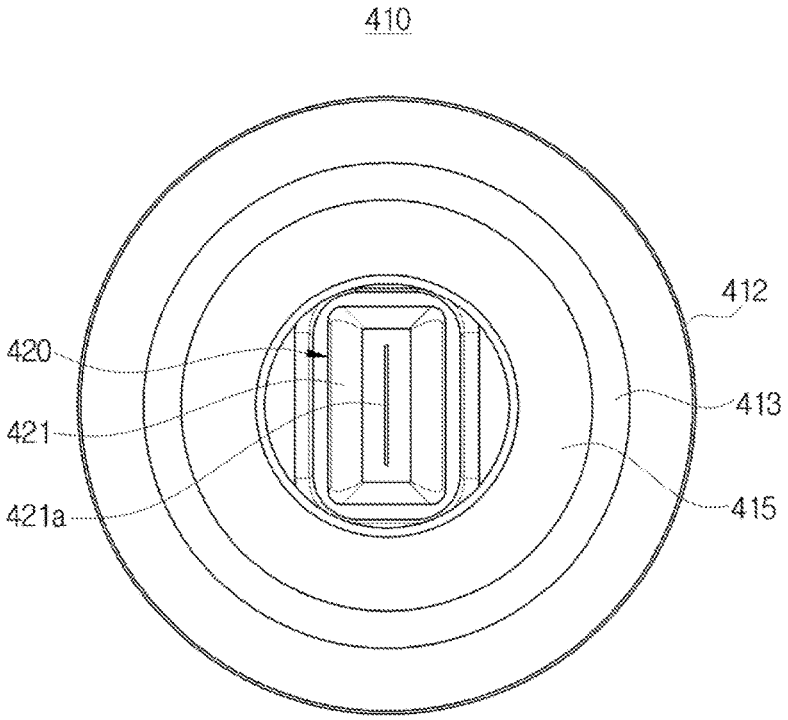
FIG. 9 is a plan view of FIG. 7.
Figure 10:
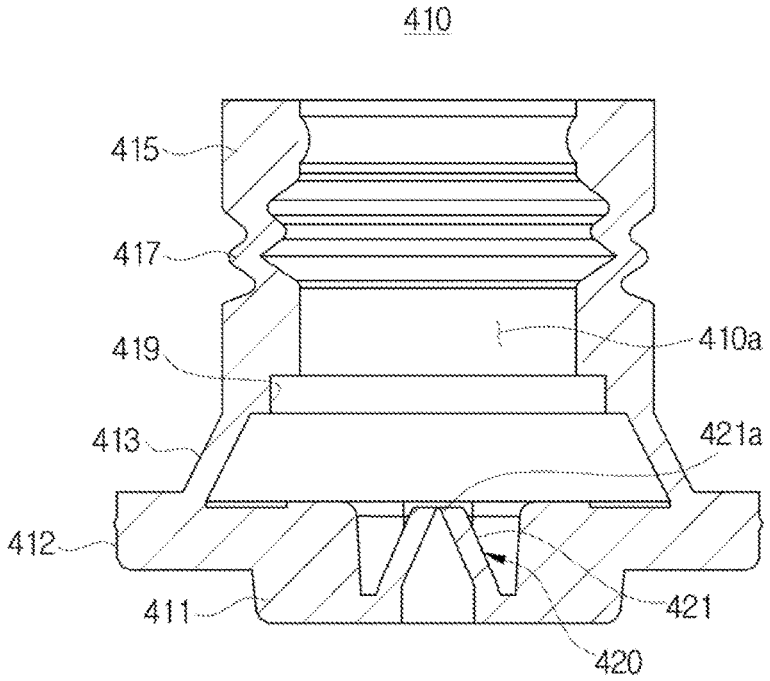
FIG. 10 is a longitudinal cross-sectional view of FIG. 7.

FIG. 7 is a perspective view illustrating the pumping member and the valve member of a pumping unit, FIG. 8 is a front view of FIG. 7, FIG. 9 is a plan view of FIG. 7, and FIG. 10 is a longitudinal cross-sectional view of FIG. 7.

As illustrated in FIGS. 7 to 10, the pumping member 410 is made of an elastic material so that the content 1 is discharged through the pumping action such as compression and expansion due to the elasticity, and the content moving passage 410*a* connected to the content inflow hole 321 of the shoulder unit 300 passes through the inside of the pumping member 410.

Also, the pumping member 410 may be made of an elastic material, e.g., a synthetic resin material having elasticity, and thus, the existing spring component may be omitted.

The pumping member 410 may include a valve mounting part 411, an elastic pumping part 413, a nozzle insertion part 415, a bellows part 417, and an undercut part 419.

The valve mounting part 411 has a hollow circular tube shape and is inserted into and coupled to the content inflow hole 321 of the shoulder 300.

Also, the valve member 420 that will be described later is provided in the valve mounting part 411 to open and close the content moving passage 410*a* of the pumping member 410.

Also, a circular hook projection 412 is disposed on an outer circumferential surface of the valve mounting part 411 and supported by the hook protrusion 323 disposed on the lower end of the inflow tube 320 of the shoulder part 300.

The elastic pumping part extends upward from the valve mounting part 411 and is elastically deformed when the pushing and pushing-releasing operation of the button unit 500 to push the content 1 within the pumping member 410 upward, thereby performing the pumping.

The elastic pumping part 413 is disposed to connect the valve mounting part 411 to the nozzle insertion part 415 below the undercut part 419 that will be described later and has a tapered (inclined) circular tube shape so that a diameter thereof gradually decreases upward.

The elastic pumping part 413 is elastically deformed inward in a radius direction of the pumping member 410 when the button unit 500 is pushed downward to press the bellows part 417 downward to perform the pumping so that the content 1 within the pumping member 410 is discharged upward along a discharge path through the opened undercut part 419.

The nozzle insertion part 415 has a hollow circular tube shape extending upward from the elastic pumping part 413.

The nozzle insertion part 415 is inserted into and coupled to the outside of the nozzle fixing tube 443 provided in the lower center of the pumping cap 440, and the nozzle member 430 is inserted into the nozzle insertion part 415.

Also, the nozzle insertion part 415 is fitted to be coupled between an outer circumferential surface of the nozzle fixing tube 443 of the pumping cap 440 and the decompression support 445.

The bellows part 417 is provided in a bellows shape at a center in a longitudinal direction of the nozzle insertion part 415, and when the pushing and pushing-releasing operation of the button unit 500 and performed, the bellows part 417 is compressed and expanded in the longitudinal direction of the nozzle insertion part 415 to perform the elastic action.

That is, the bellows part 417 may serve as the existing spring through the compression and expansion due to the elasticity.

The bellows part 417 may be elastically deformed through the compression and expansion in only the longitudinal direction of the pumping member 410, i.e., in a vertical direction without being elastically deformed to the inside and outside in the radius direction of the pumping member 410, i.e., in a horizontal direction when the pushing and pushing-releasing operation of the button unit 500 is performed and thereby to serve as the spring. Thus, when the decompression vacuum test is performed on the case of the liquid state cosmetics, the opening of the undercut part 419 due to a pressure within the pumping member 410 is prevented to prevent the content 1 from leaking through the undercut part 419, thereby improving the decompression effect.

The undercut part 419 is stepped so that a lower inner diameter thereof is more expanded than an upper inner diameter thereof on an inner circumferential surface of the nozzle insertion part 415.

In the state in which the nozzle member 430 that will be described later is inserted into the nozzle insertion part 415, the annular flange part 435 protruding outward at the lower end of the nozzle member 430 is closely attached to and supported by the undercut part 419.

The undercut part 419 is provided as an annular stepped groove having an inner diameter corresponding to an outer diameter of the annular flange part 435 on an inner circumferential surface of a connected portion between the upper end of the elastic pumping part 413 and the lower end of the nozzle insertion part 415.

As described above, since the undercut part 419 is provided on the pumping member 410, when the button unit 500 is pushed downward, the bellows part 417 is compressed downward by the pumping cap 440, and thus, the nozzle member 430 descends. As a result, the attachment of the flange part 435 to the undercut part 419 is released, and thus, the undercut part 419 is opened so that the content 1 is discharged through the undercut part 419. When the button unit 500 returns upward, the bellows part 417 is expanded upward, and thus, the nozzle member 430 ascends. As a result, the flange part 435 is closely attached to the undercut part 419 to seal the undercut part 419, thereby blocking the discharge of the content 1.

Also, when the decompression vacuum test is performed on the case 10 for the liquid state cosmetics, the flange part 435 of the nozzle member 430 is closely attached by the undercut part 419 to prevent the undercut part 410 from being opened by the internal pressure of the case 10, thereby preventing the content 1 from leaking through the undercut part 419.

For example, in the case in which the flange part 435 of the nozzle member 430 and the undercut part 419 of the pumping member 410 are not provided in the pumping unit 400, when the decompression vacuum test is performed, the content 1 may leak between the nozzle member 430 and the pumping member 410 at a pressure of about 200 bars. However, like the present invention, in the case in which the flange part 435 of the nozzle member 430 and the undercut part 419 of the pumping member 410 are provided in the pumping unit 400, the flange part 435 may be closely attached to and supported by the undercut part 410. Thus, when the decompression vacuum test is performed, the leakage of the content 1 may be prevented in a range of about 800 bar to about 1,000 bar to improve reliability of a product.

The valve member 420 is disposed below the pumping member 410 to open and close the content moving passage 410*a* communicating with the content inflow hole 321.

The valve member 420 is integrated with the pumping member 410.

Thus, if the valve member 420 is provided as a separate part with respect to the pumping member 410, the content 1 may leak through the coupled portion between the valve member 420 and the pumping member 410, and also, the assembly may be complicated. Therefore, it is preferable that the valve member 420 is integrated with the pumping member 410.

In this embodiment, although the valve member 420 is integrated with the pumping member 410, the present invention is not limited thereto. For example, the valve member 420 may be provided as a separate part and then be coupled to the pumping member 410.

The valve member 420 may include a check valve 421 which extends to the inside of the valve mounting part 411 to form an upward cone shape and in which a straight slit hole 421*a* is defined in an upper end thereof so that the slit hole 421*a* is spread or closed by a pressure to open and close the content moving passage 410*a*.

The check valve 421 is made of an elastic material so that the slit hole 421*a* is spread and closed by the pressure.

Figure 11:
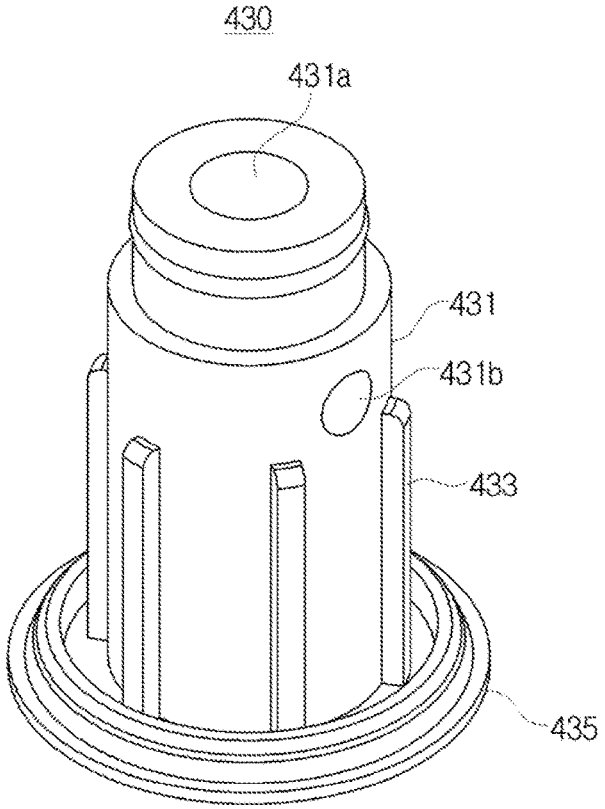
FIG. 11 is a perspective view illustrating a nozzle member of a pumping unit.
Figure 12:
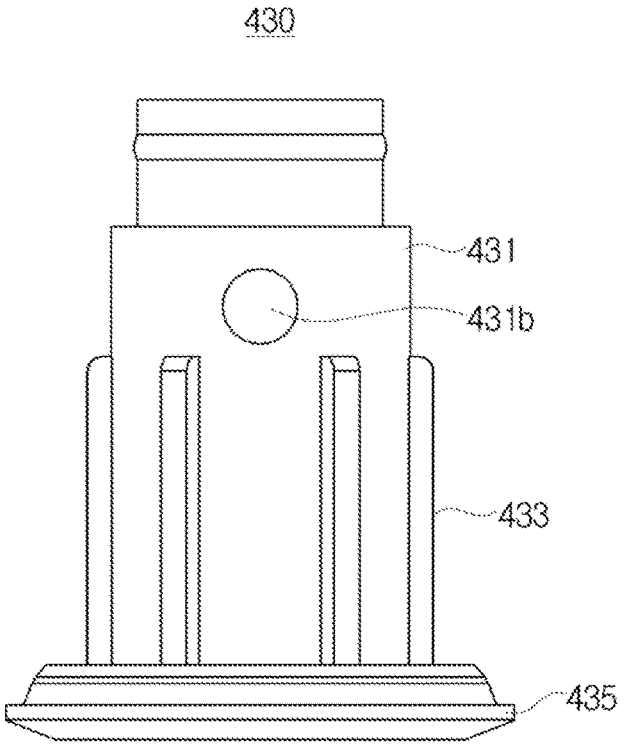
FIG. 12 is a front view of FIG. 11.
Figure 13:
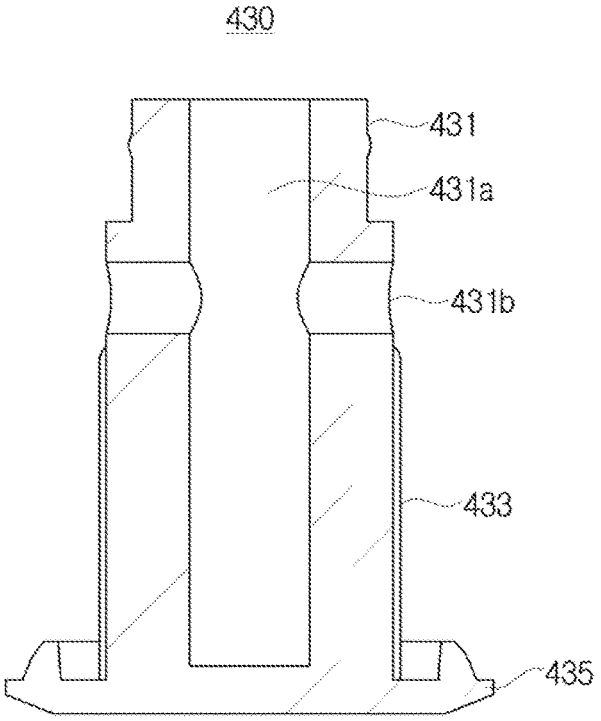
FIG. 13 is a longitudinal cross-sectional view of FIG. 11.

FIG. 11 is a perspective view illustrating the nozzle member of the pumping unit, FIG. 12 is a front view of FIG. 11, and FIG. 13 is a longitudinal cross-sectional view of FIG. 11.

As illustrated in FIGS. 11 to 13, the nozzle member 430 is inserted into the upper portion of the pumping member 410 in the state of being fixed to the nozzle fixing tube 443 of the pumping cap 440. When the pumping member 410 is elastically deformed, the nozzle member 430 comes into contact or non-contact with the pumping member 410 to open and close the upper side of the contact moving passage 410*a*.

The nozzle member 430 may include the nozzle body 431, the inflow guide piece 433, and the flange part 435.

The nozzle body 431 is inserted into and coupled to the nozzle fixing tube 443 protruding from the lower portion of the pumping cap 440, and a nozzle hole 431*a* having a closed lower end and opened upper end is lengthily defined inside the nozzle body 431. A nozzle inflow hole 431*b* connected to the nozzle hole 431*a* to allow the content 1 to be introduced into the nozzle hole 431*a* is defined in a side portion of the nozzle body 431.

Also, the upper end of the nozzle body 431 is fitted into and fixed to the discharge hole 422 defined in the upper end of the nozzle fixing tube 443 in the state in which the nozzle body 431 is inserted into the nozzle fixing tube 443.

The inflow guide piece 433 is provided in plurality that radially protrude from an outer circumferential surface of the nozzle body 431. An inflow path for the content 1 is provided in the inflow guide piece 433 to guide the content 1 to the nozzle inflow hole 431*b* so that the content 1 passes through a gap between the nozzle fixing tube 443 and the nozzle body 431 in the state in which the nozzle body 431 is inserted into the nozzle fixing tube 443.

The flange part 435 protrudes in an annular shape from a lower end of the nozzle body, has an outer diameter corresponding to the inner diameter of the undercut part 419, and is inserted into the nozzle insertion part 415 and closely attached to and supported by the undercut part 419.

Thus, since the flange part 435 of the nozzle member 430 is inserted into the nozzle insertion part 415 of the pumping member of the flange part 435 and thus is closely attached to the undercut part 419, when the decompression vacuum test is performed on the case 10, the undercut par 419 may be prevented from being opened by the internal pressure of the case 10, thereby preventing the content 1 from leaking through the undercut part 419.

Figure 14:
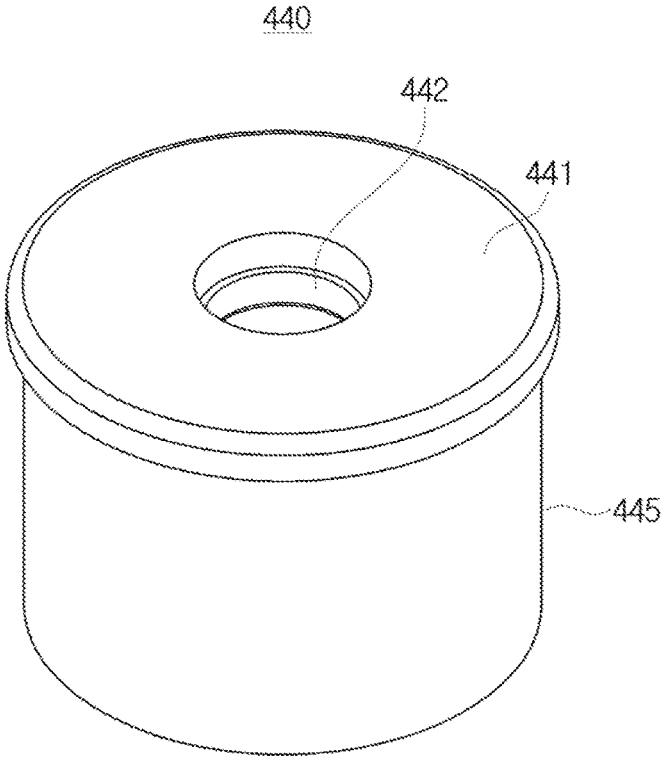
FIG. 14 is a perspective view illustrating a pumping cap of the pumping unit.
Figure 15:
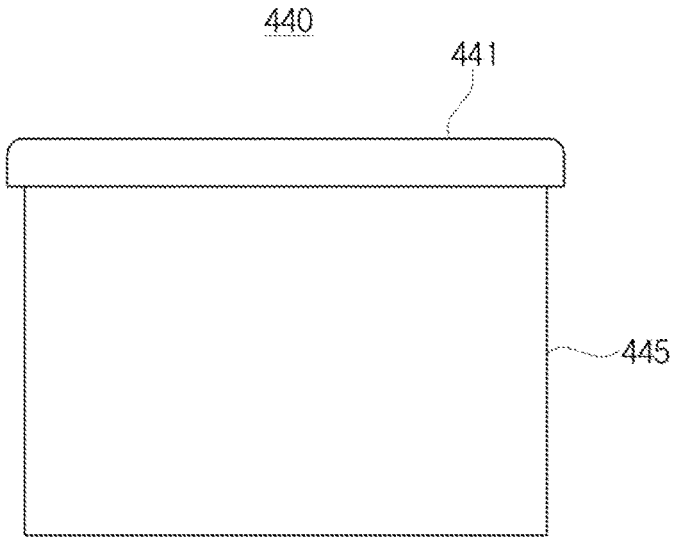
FIG. 15 is a front view of FIG. 14.
Figure 16:
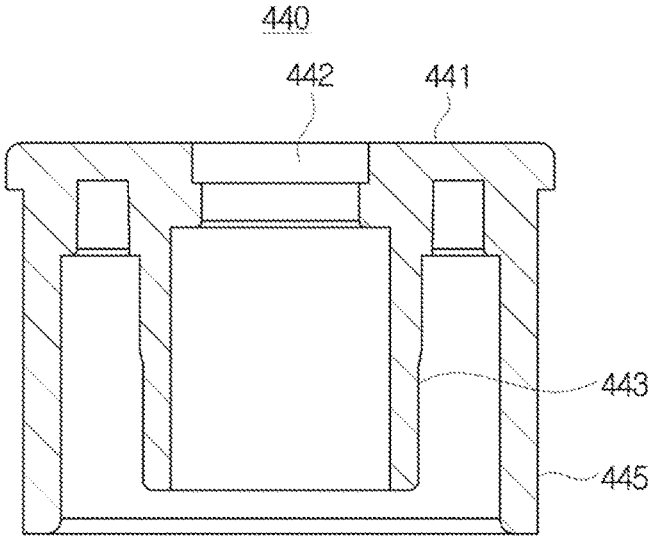
FIG. 16 is a longitudinal cross-sectional view of FIG. 14.

FIG. 14 is a perspective view illustrating the pumping cap of the pumping unit, FIG. 15 is a front view of FIG. 14, and FIG. 16 is a longitudinal cross-sectional view of FIG. 14.

As illustrated in FIGS. 14 to 16, the pumping cap 440 is inserted into and coupled to the button stem part 520 disposed on a lower portion of the button unit 500, and a lower end of the pumping cap 440 is coupled to an upper end of the pumping member 410 in the state in which the nozzle member 430 is inserted into the pumping cap 440.

The pumping cap 440 may include the cap body 441, the nozzle fixing tube 443, and the decompression support 445.

The cap body 441 has a circular shape and is inserted into and coupled to the button stem part 520 of the button unit 500.

Here, the cap body 441 has an outer diameter corresponding to an inner diameter of the button stem part 520.

A discharge hole 442 is defined in a center of the cap body 441. When the cap body 441 is inserted into the button stem part 520 of the button unit 500, the discharge hole 442 is connected to the outlet hole 501 of the button unit 500.

The nozzle fixing tube 443 has a circular tube shape protruding from a lower center of the cap body 441, and the nozzle body 431 is inserted into and fixed to the nozzle fixing tube 443 through a lower opening.

The nozzle fixing tube 443 has an upper portion communicating with the discharge hole 442 of the cap body 441 and a lower end inserted into and coupled to the inside of the upper end of the pumping member 410.

The decompression support 445 has a circular tube shape extending to protrude from the lower portion of the cap body 441 at a predetermined distance with respect to the outer circumferential surface of the nozzle fixing tube 443, e.g., a distance corresponding to a thickness of a sidewall of the nozzle insertion part 415 to support the outer circumferential surface of the nozzle insertion part 415 coupled to the outside of the nozzle fixing tube 443.

Here, the decompression support 445 extends up to the connected portion between the upper end of the elastic pumping part 413 and the lower end of the nozzle insertion part 415, i.e., a position on which the undercut part 419 is disposed.

Figure 17:
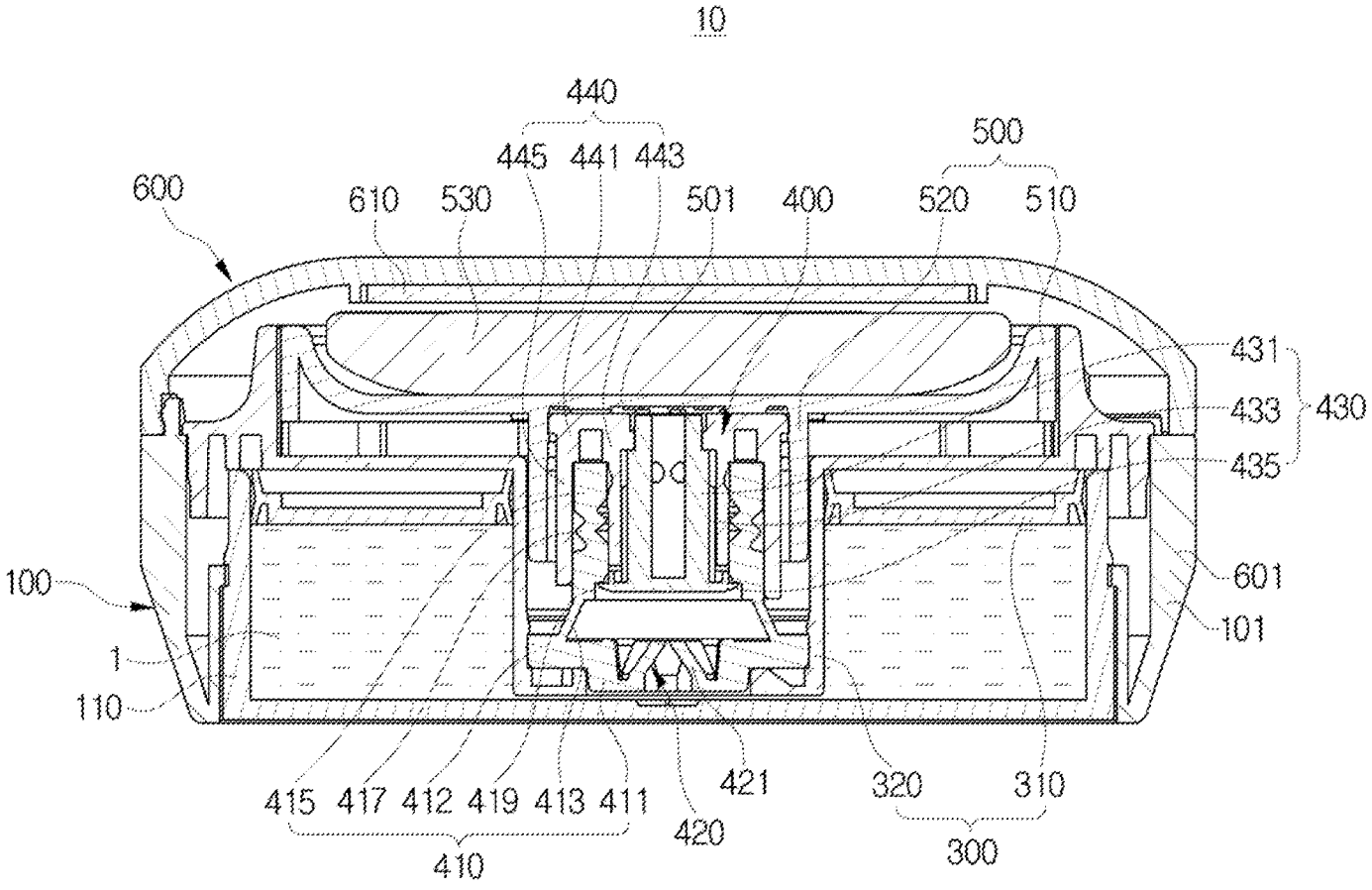
FIG. 17 is a view illustrating an operation state when a decompression vacuum test is performed on the case for the liquid state cosmetics according to an embodiment of the present invention.

FIG. 17 is a view illustrating an operation state when the decompression vacuum test is performed on the case for the liquid state cosmetics according to an embodiment of the present invention.

As illustrated in FIG. 17, since the decompression support 445 provided on the pumping cap 440 supports the outside of the nozzle insertion part 415 on which the undercut part 419 is disposed when the decompression vacuum test is performed on the case 10 for the liquid state cosmetics, the undercut part 419 may be prevented from being deformed by the pressure within the pumping member 410 to prevent the undercut part 419 from being opened, thereby preventing the content 1 from leaking through the undercut part 419.

When the decompression support 445 is not provided, the undercut part 415 may be deformed to be opened when the decompression occurs and thereby to cause the leakage of the content 1. Thus, according to the present invention, the decompression support 445 may be provided to previously prevent the content 1 from leaking when the decompression occurs.

Figure 18:
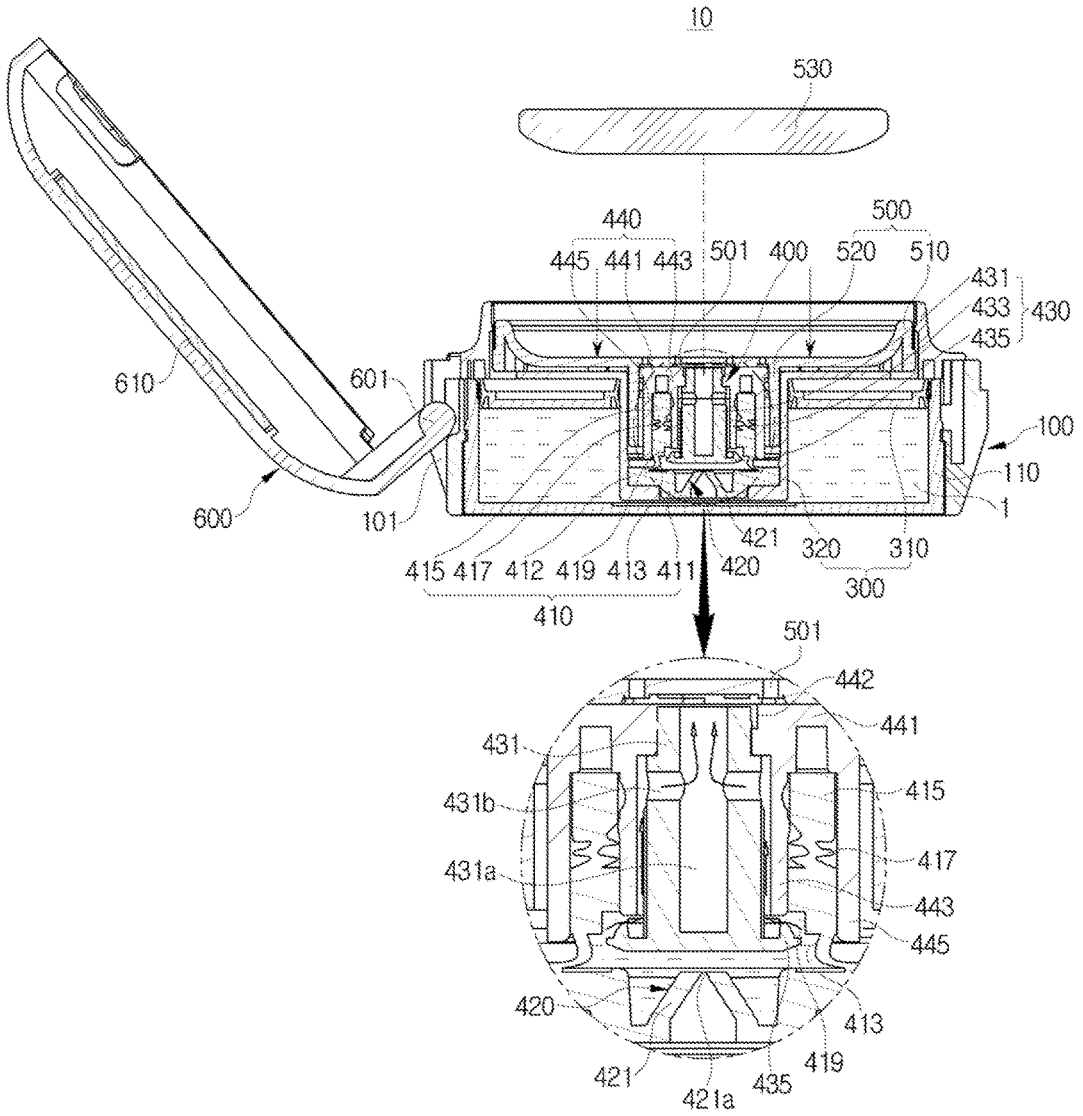
FIG. 18 is a view illustrating an operation state in which a content within the case for the liquid state cosmetics is discharged according to an embodiment of the present invention.

FIG. 18 is a view illustrating an operation state in which the content within the case for the liquid cosmetics is discharged according to an embodiment of the present invention.

As illustrated in FIG. 18, when the button unit 500 is pushed downward, the slit hole 421*a* is closed by the pressure within the pumping member 410 to seal the check valve 421. After the check valve 421 is sealed first, the bellows part 417 is compressed downward by the pumping cap 440, and then the nozzle member 430 descends. As a result, the close attachment of the flange part 435 of the nozzle member 430 to the undercut part 419 is released to open the undercut part 419, thereby discharging the content 1 within the pumping member 410 through the undercut part 419.

Here, the elastic pumping part 413 disposed on the lower portion of the undercut part 419 is elastically deformed inward in a radius direction of the pumping member 410 when the button unit 500 is pushed downward to press the bellows part 417 downward to perform the pumping so that the content 1 within the pumping member 410 is discharged upward along a discharge path through the opened undercut part 419.

The content 1 discharged upward through the undercut part 419 is guided to the nozzle inflow hole 431*b* of the nozzle member 430 through the inflow guide piece 433 and is introduced into the nozzle hole 431*a*. Then, the content 1 is discharged to the discharge hole 442 of the pumping cap 440 through the nozzle hole 431*a* and then is discharged through the content outlet hole 501.

As described above, when the button unit 500 is pushed, the bellows part 417 of the pumping member 410 is compressed before the internal pressure is applied to the pumping member 410 to open the undercut part 419. Thus, the content 1 may be smoothly discharged by a fixed quantity in the state in which the apply of the internal pressure is released from the pumping member 410.

Figure 19:
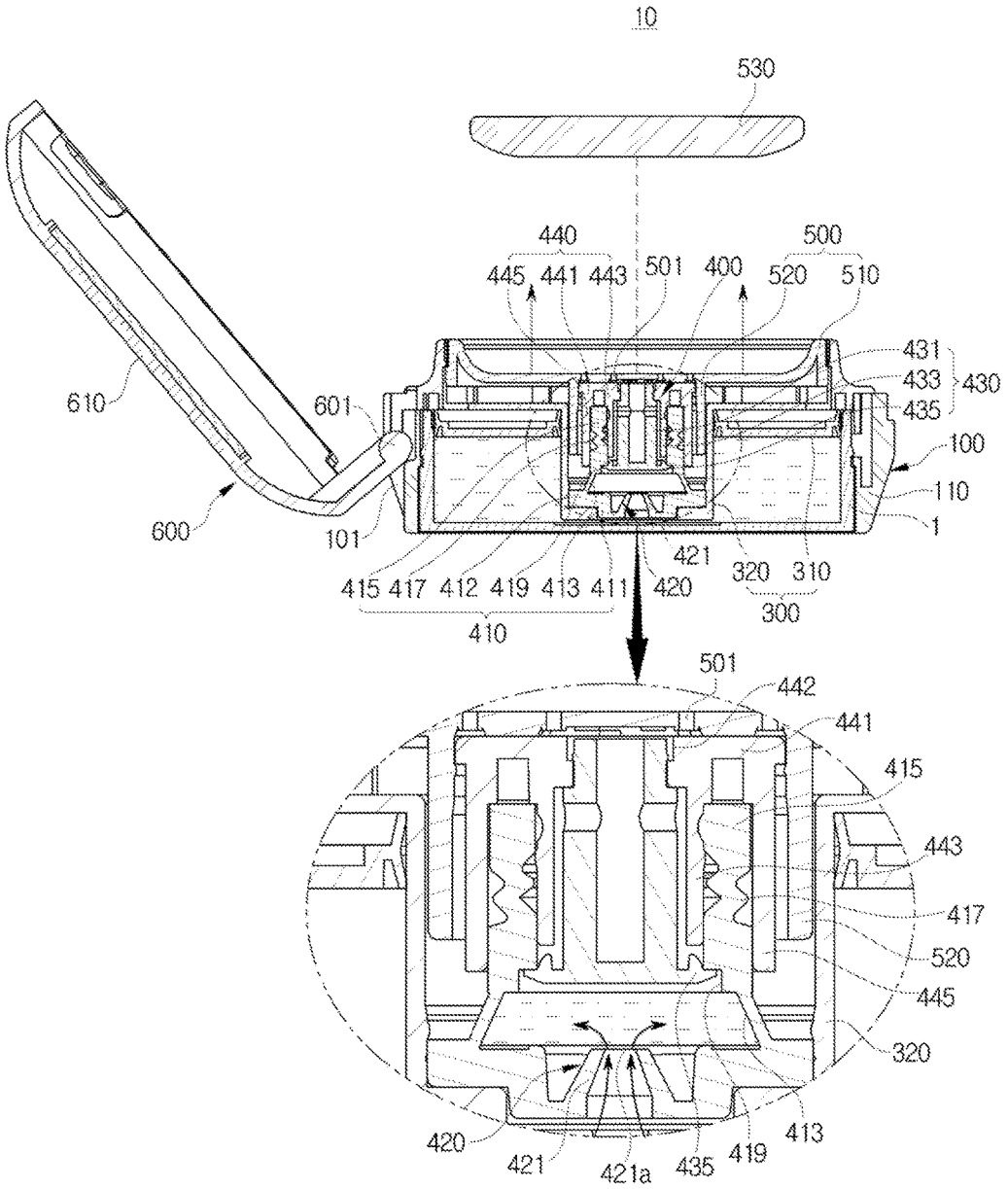
FIG. 19 is a view illustrating an operation state in which the discharge of the content within the case for the liquid state cosmetics is blocked according to an embodiment of the present invention.

FIG. 19 is a view illustrating an operation state in which the discharge of the content within the case for the liquid cosmetics is blocked according to an embodiment of the present invention.

As illustrated in FIG. 19, when the pushing of the button unit 500 is released, the bellows part 417 is expanded upward by the elasticity to allow the button unit 500 to return upward. Then, the bellows part 417 is expanded upward to allow the nozzle member 430 to ascend, and thus, the flange part 435 is closely attached to the undercut part 419 to seal the undercut part 419 and thereby to prevent the content 1 from being discharged. After the undercut part 419 is closed first, the slit hole 421*a* is opened by the pressure within the case body 100 to open the check valve 421 so that the content 1 is filled into the pumping member 410.

Thus, the pushing and pushing-releasing operation of the button unit 500 are repeatedly performed to discharge the content 1 and also always fill the content 1 into the pumping member 410 while being introduced into the pumping member 410.

Figure 20:
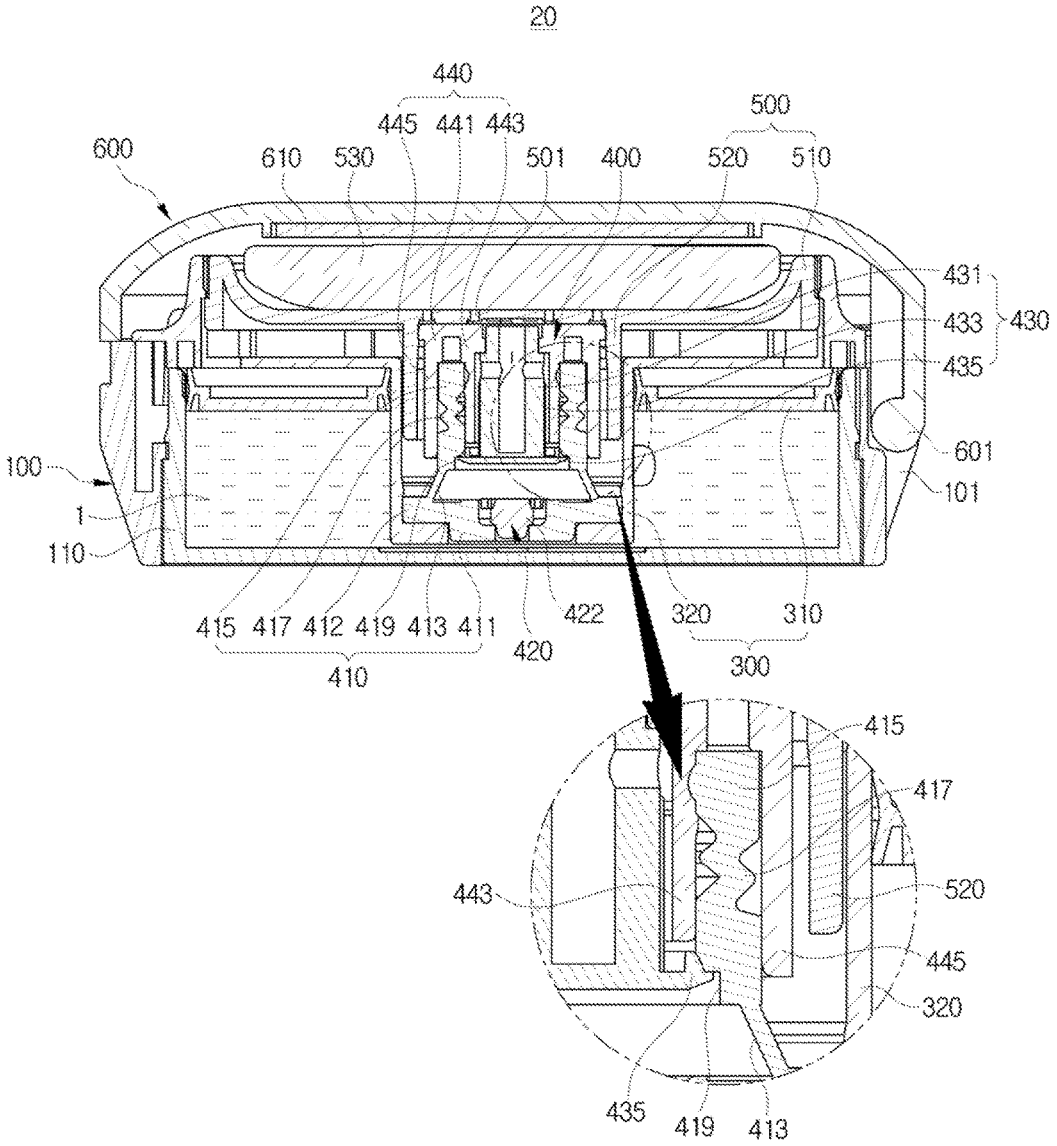
FIG. 20 is a longitudinal cross-sectional view of a case for liquid type cosmetics according to another embodiment of the present invention.
Figure 21:
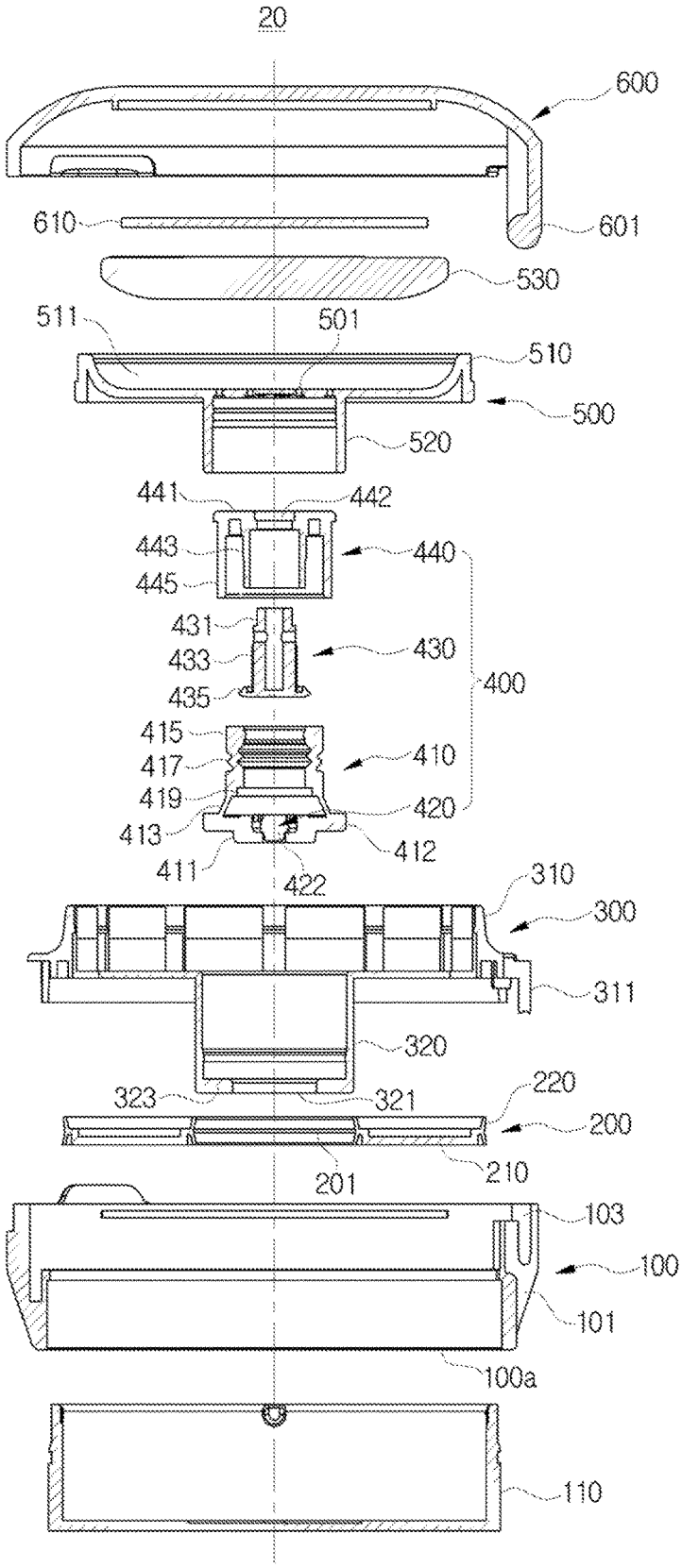
FIG. 21 is an exploded view of FIG. 20.

FIG. 20 is a longitudinal cross-sectional view of a case for liquid type cosmetics according to another embodiment of the present invention, and FIG. 21 is an exploded view of FIG. 20.

As illustrated in FIGS. 20 and 21, a case 20 for liquid state cosmetics according to another embodiment of the present invention may include a case body 100, a piston unit 200, a shoulder unit 300, a pumping unit 400, a button unit 500, and a case cap 600.

This embodiment of the present invention is the same as the above-mentioned embodiment, which is described with reference to FIGS. 1 to 19, except for a pumping unit 400 having a disk valve 422.

Thus, detailed descriptions of the case body 100, the piston unit 200, the shoulder unit 300, the button unit 500, and the case cap 600, which are components for performing the same function as those according to the above-mentioned embodiment, will be omitted, and thus, only the pumping unit 400 that is different from that according to the above-mentioned embodiment will be described in detail.

Figure 22:
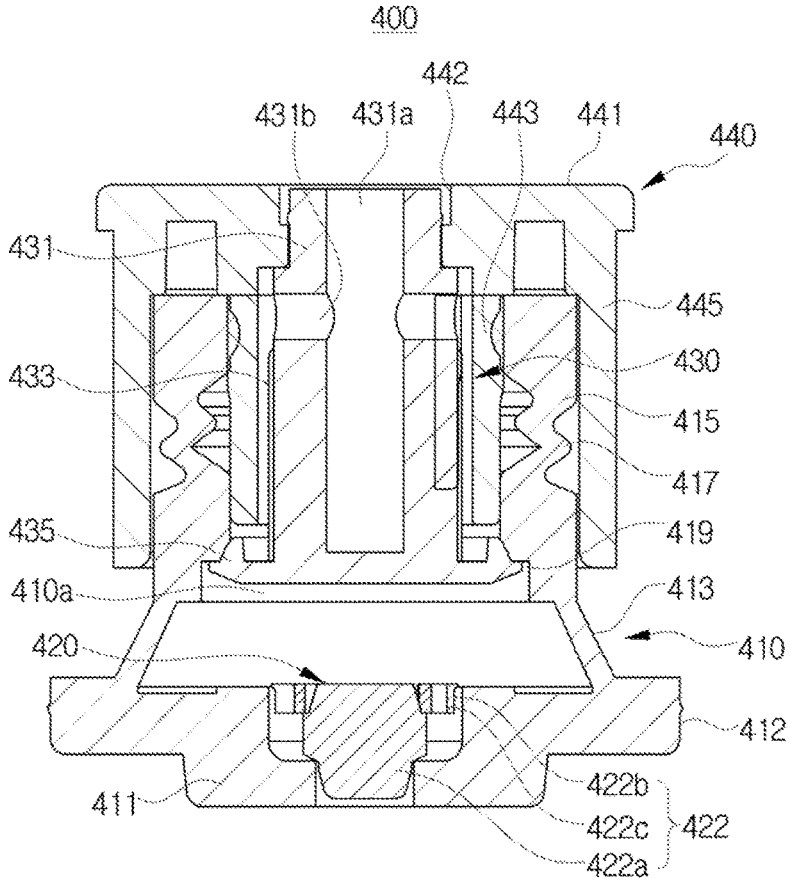
FIG. 22 is a longitudinal cross-sectional view illustrating a pumping unit of the case for the liquid state cosmetics according to another embodiment of the present invention.
Figure 23:
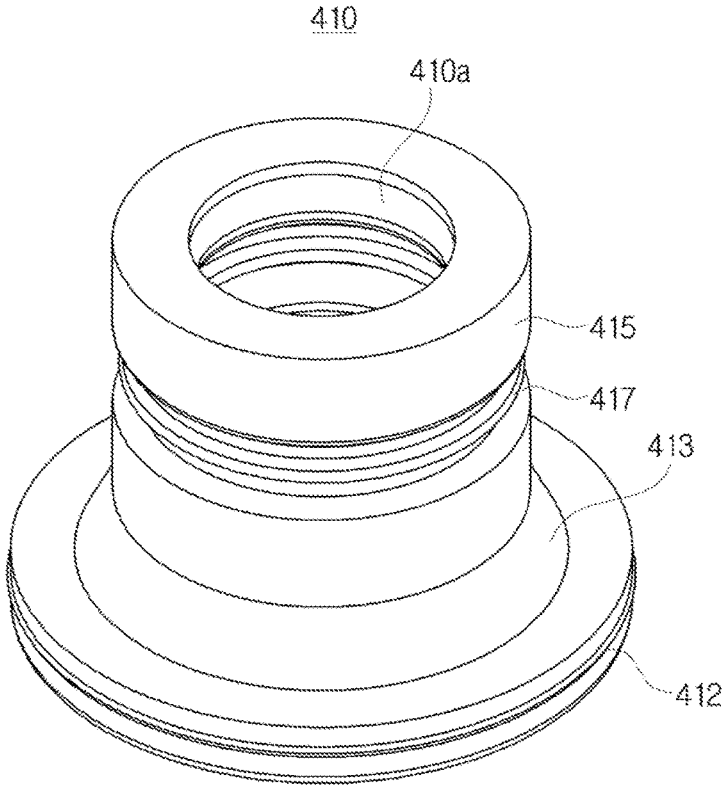
FIG. 23 is a perspective view illustrating a pumping member and a valve member of the pumping unit.
Figure 24:
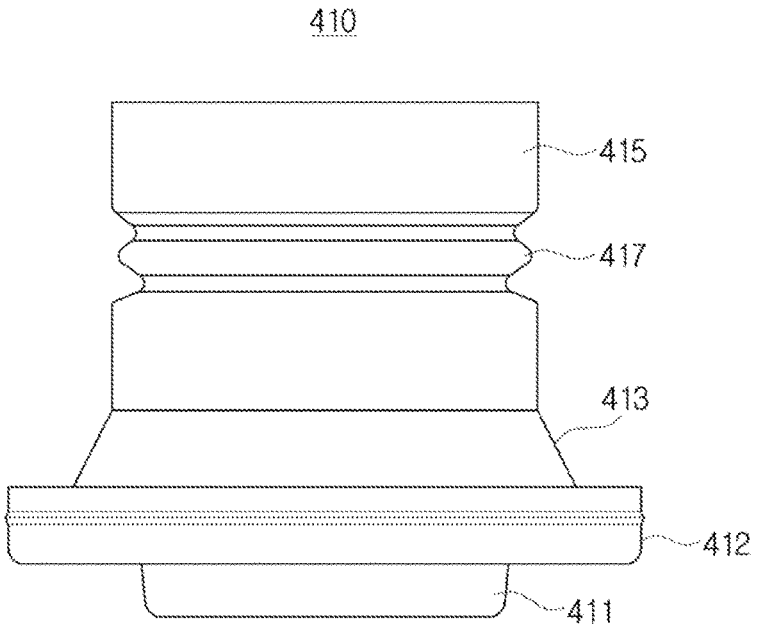
FIG. 24 is a front view of FIG. 23.
Figure 25:
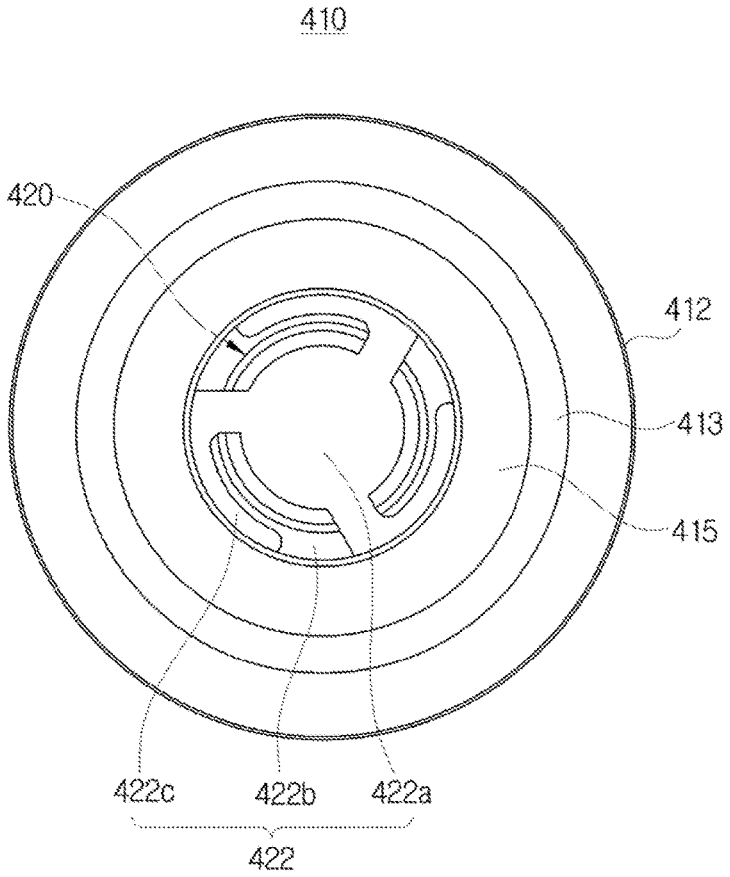
FIG. 25 is a plan view of FIG. 23.
Figure 26:
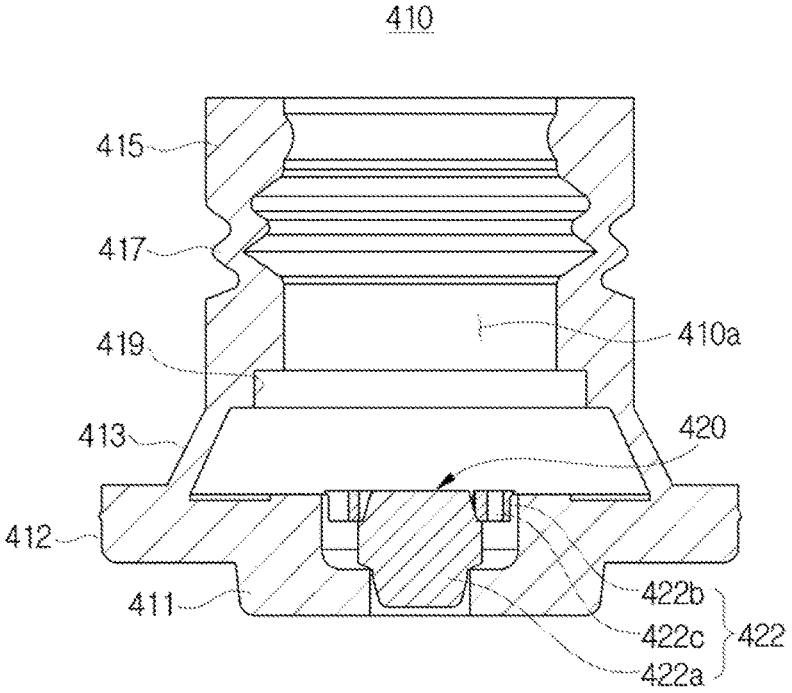
FIG. 26 is a longitudinal cross-sectional view of FIG. 23.

FIG. 22 is a longitudinal cross-sectional view illustrating the pumping unit of the case for the liquid state cosmetics according to another embodiment of the present invention, FIG. 23 is a perspective view illustrating a pumping member and a valve member of the pumping unit, FIG. 24 is a front view of FIG. 23, FIG. 25 is a plan view of FIG. 23, and FIG. 26 is a longitudinal cross-sectional view of FIG. 23.

As illustrated in FIGS. 22 to 26, the pumping unit 400 of the case 20 of the liquid state cosmetics according to another embodiment of the present invention may include the pumping member 410, a valve member 420, a nozzle member 430, and a pumping cap 440.

Here, the pumping member 410, the nozzle member 430, and the pumping cap 440 are the same as those according to the above-mentioned embodiment, and thus their detailed description will be omitted, and only the valve member 420 that is different from that according to the above-mentioned embodiment will be described in detail.

The valve member 420 is disposed below the pumping member 410 to open and close the content moving passage 410*a* communicating with the content inflow hole 321.

In this embodiment, the valve member 420 is provided as a disk valve 422, and the disk valve 422 is made of the same material as the pumping member 410.

In this embodiment, although the disk valve 422 is integrated with the pumping member 410, the present invention is not limited thereto. For example, the disk valve 422 may be provided as a separate part and then be coupled to the pumping member 410.

The disk valve 422 is provided in a disk plate 422*a* or a disk block shape inside a valve mounting part 411. A plurality of valve holes 422*c* are defined between elastic connection pieces 422*b* connecting the disk plate 422*a* to the valve mounting part 411, and the disk plate 422*a* ascend and descend by elastic deformation of the elastic connection pieces 422*b* to open and close a content moving passage 410*a* within the valve mounting part 411.

Figure 27:
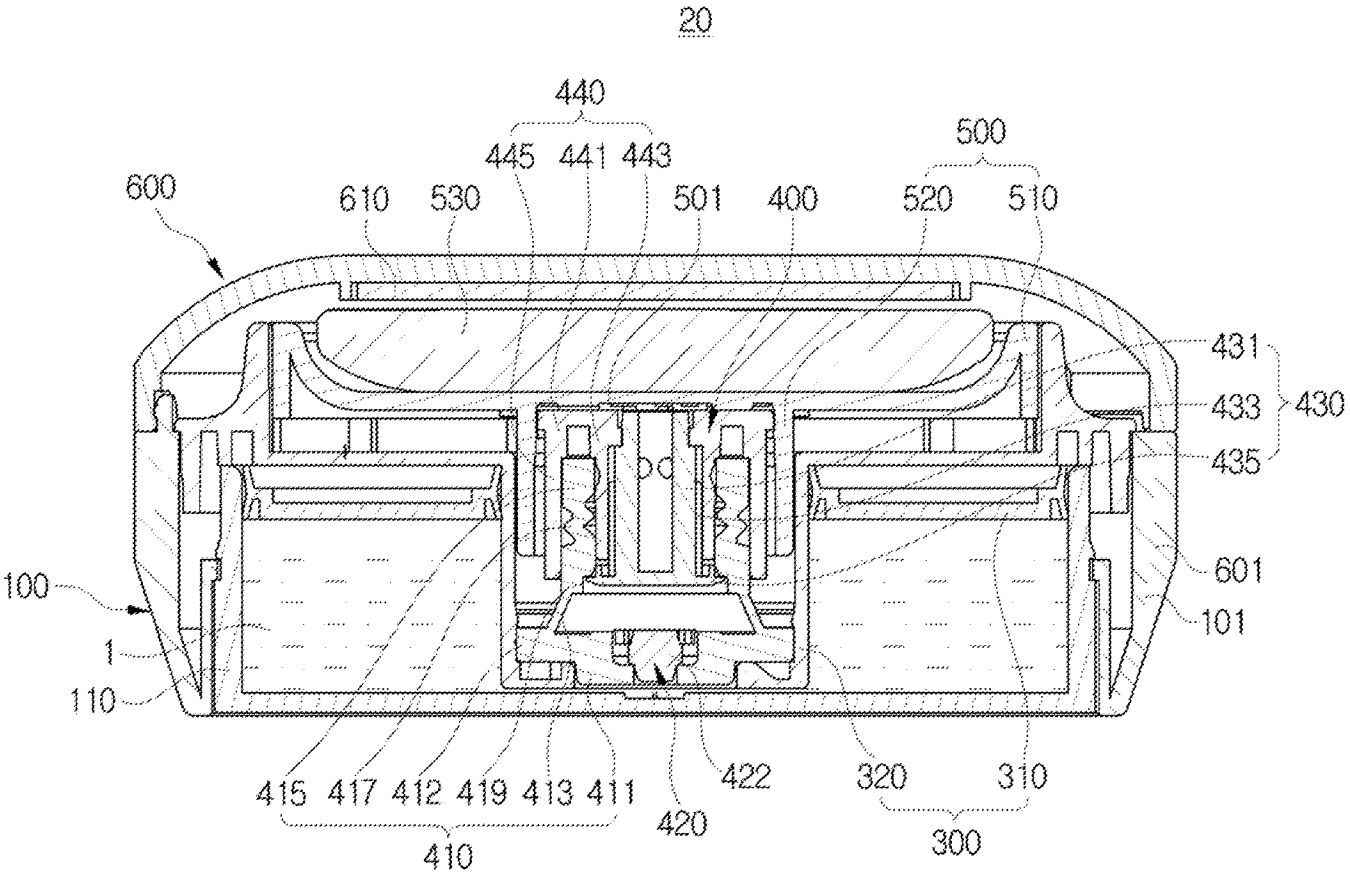
FIG. 27 is a view illustrating an operation state in which a decompression vacuum test is performed on the case for the liquid state cosmetics according to another embodiment of the present invention.

FIG. 27 is a view illustrating an operation state in which a decompression vacuum test is performed on the case for the liquid state cosmetics according to another embodiment of the present invention.

As illustrated in FIG. 27, since a decompression support 445 provided on the pumping cap 440 supports the outside of a nozzle insertion part 415 on which an undercut part 419 is disposed when a decompression vacuum test is performed on the case 20 for the liquid state cosmetics, the undercut part 419 may be prevented from being deformed by a pressure within the pumping member 410 to prevent the undercut part 419 from being opened, thereby preventing the content 1 from leaking through the undercut part 419.

When the decompression support 445 is not provided, the undercut part 419 may be deformed to be opened when the decompression occurs and thereby to cause the leakage of the content 1. Thus, according to the present invention, the decompression support 445 may be provided to previously prevent the content 1 from leaking when the decompression occurs.

Figure 28:
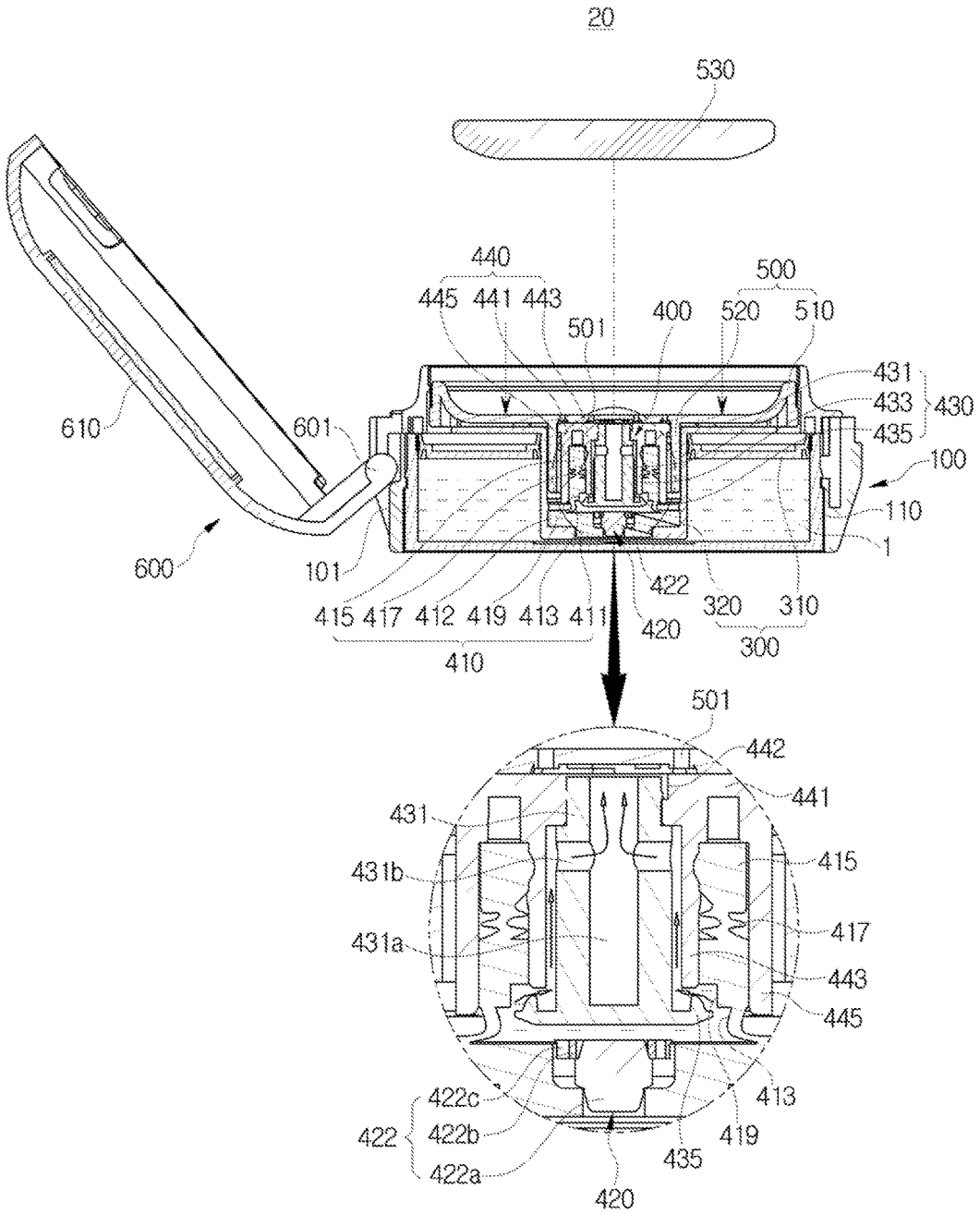
FIG. 28 is a view illustrating an operation state in which a content within the case for the liquid state cosmetics is discharged according to another embodiment of the present invention.

FIG. 28 is a view illustrating an operation state in which a content within the case for the liquid state cosmetics is discharged according to another embodiment of the present invention.

As illustrated in FIG. 28, when the button unit 500 is pushed downward, the disk plate 422*a* descends by the pressure within the pumping member 410 to seal a disk valve 422. After the disk valve 422 is sealed first, a bellows part 417 is compressed downward by the pumping cap 440, and then a nozzle member 430 descends. As a result, the close attachment of a flange part 435 of the nozzle member 430 to the undercut part 419 is released to open the undercut part 419, thereby discharging the content 1 within the pumping member 410 through the undercut part 419.

Here, the elastic pumping part 413 disposed below the undercut part 419 is elastically deformed inward in a radius direction of the pumping member 410 when the button unit 500 is pushed downward to press the bellows part 417 downward to perform the pumping so that the content 1 within the pumping member 410 is discharged upward along a discharge path through the opened undercut part 419.

The content 1 discharged upward through the undercut part 419 is guided to a nozzle inflow hole 431*b* of the nozzle member 430 through an inflow guide piece 433 and is introduced into a nozzle hole 431*a*. Then, the content 1 is discharged to a discharge hole 442 of the pumping cap 440 through the nozzle hole 431*a* and then is discharged through a content outlet hole 501.

As described above, when the button unit 500 is pushed, the bellows part 417 of the pumping member 410 is compressed before the internal pressure is applied to the pumping member 410 to open the undercut part 419. Thus, the content 1 may be smoothly discharged by a fixed quantity in the state in which the apply of the internal pressure is released from the pumping member 410.

Figure 29:
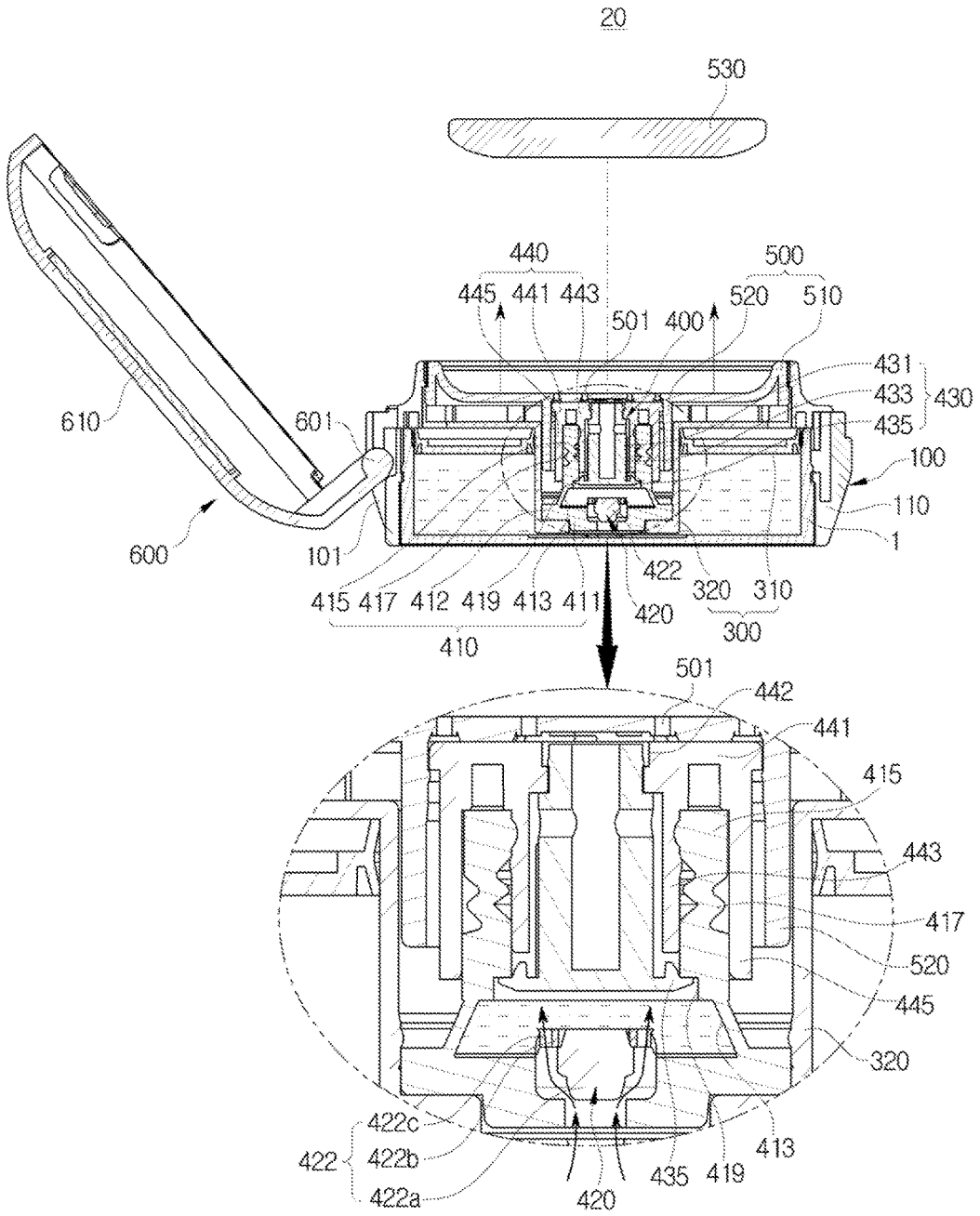
FIG. 29 is a view illustrating an operation state in which the discharge of the content within the case for the liquid state cosmetics is blocked according to another embodiment of the present invention.

FIG. 29 is a view illustrating an operation state in which the discharge of the content within the case for the liquid state cosmetics is blocked according to another embodiment of the present invention.

As illustrated in FIG. 29, when the pushing of the button unit 500 is released, the bellows part 417 is expanded upward by the elasticity to allow the button unit 500 to return upward. Then, the bellows part 417 is expanded upward to allow the nozzle member 430 to ascend, and thus, the flange part 435 is closely attached to the undercut part 419 to seal the undercut part 419 and thereby to prevent the content 1 from being discharged. After the undercut part 419 is closed first, the disk plate 422*a* ascends by the pressure within the case body 100 to open the disk valve 422 so that the content 1 is filled into the pumping member 410.

Thus, the pushing and pushing-releasing operation of the button unit 500 are repeatedly performed to discharge the content 1 and also always fill the content 1 into the pumping member 410 while being introduced into the pumping member 410.

In the case for the liquid state cosmetics according to the present invention, the content pumping member may be made of the elastic material, e.g., the synthetic resin material having the elasticity, and thus, the existing spring component may be omitted.

Thus, the number of parts of the case for the cosmetics may be reduced to simplify the structure of the case, thereby reducing the manufacturing costs.

In addition, since the pumping action is performed using the elastic synthetic resin instead of the existing spring made of the metal material, the spring made of the metal material may not be used to prevent the content from being deteriorated due to corrosion of the spring.

In addition, when the decompression vacuum test is performed on the case for the liquid state cosmetics, the flange part of the nozzle member may be closely attached to and supported by the undercut part of the pumping member to prevent the undercut part from being opened by the internal pressure of the case, thereby preventing the content from leaking through the undercut part.

For example, if the undercut part is not provided, like the related art, when the decompression vacuum test is performed, the content may leak between the nozzle member and the pumping member at the pressure of about 200 bars. However, like the present invention, in the case in which the flange part of the nozzle member and the undercut part of the pumping member are provided in the pumping unit, the flange part may be closely attached to and supported by the undercut part. Thus, when the decompression vacuum test is performed, the leakage of the content may be prevented in a range of about 800 bars to about 1,000 bars to improve reliability of a product.

In addition, when the decompression vacuum test is performed on the case for the liquid state cosmetics, the outside of the nozzle insertion part on which the undercut part is disposed may be supported by the decompression support to prevent the undercut from being deformed by the pressure within the pumping member and thereby to prevent the undercut part from being opened, thereby preventing the content from leaking through the undercut part.

If the decompression support is not provided, when the decompression occurs, the undercut part may be deformed and opened to cause the automatic leakage of the content. Thus, according to the present invention, the decompression support may be provided to previously prevent the content from leaking when the decompression occurs.

In addition, when the pushing and pushing-releasing operation of the button unit are performed, the bellows part provided in the pumping member may be elastically deformed through the compression and expansion in only the longitudinal direction of the pumping member, i.e., in the vertical direction without being elastically deformed to the inside and outside in the radius direction of the pumping member, i.e., in the horizontal direction to serve as the spring. Thus, when the decompression vacuum test is performed on the case of the liquid state cosmetics, the opening of the undercut part due to the pressure within the pumping member may be prevented to prevent the content from leaking through the undercut part, thereby improving the decompression effect.

In addition, when the button unit is pushed downward to compress the bellows part downward, the elastic pumping part disposed below the undercut part may be elastically deformed inward in the radius direction of the pumping member to perform the pumping so that the content within the pumping member is smoothly discharged upward along the discharge path through the opened undercut part.

In addition, when the button unit is pushed, the bellows part of the pumping member may be compressed before the internal pressure is applied to the pumping member to open the undercut part. Thus, in the state in which the apply of the internal pressure is released from the pumping member, the content may be smoothly discharged by the fixed quantity.

Also, the valve member constituted by the check valve or the disk valve may be integrated with the pumping member.

Thus, if the valve member is provided as a separate part with respect to the pumping member, the content may leak through the coupled portion between the valve member and the pumping member, and also, the assembly may be complicated. However, according to the present invention, when the valve member is integrated with the pumping member, the occurrence of the leakage of the content through the coupled portion between the valve member and the pumping member may be prevented, and the number of parts may be reduced to simplify the structure of the case, thereby reducing the manufacturing costs.

Although the embodiment of the present invention is described with reference to the accompanying drawings, those with ordinary skill in the technical field of the present invention pertains will be understood that the present invention can be carried out in other specific forms without changing the technical idea or essential features.

Thus, the above-disclosed embodiments are to be considered illustrative and not restrictive.

Accordingly, the scope of the present invention is defined by the appended claims rather than the foregoing description and the exemplary embodiments described therein. Various modifications made within the meaning of an equivalent of the claims of the invention and within the claims are to be regarded to be in the scope of the present invention.

What is claimed is:

1. A case for liquid state cosmetics, the case comprising:

a case body provided with a content storage part in which the liquid content is stored;

a shoulder unit coupled to close an upper portion of the case body and provided with an inflow part having a content inflow hole in a center thereof;

a piston unit disposed in the case body to move according to discharge of the content;

a pumping unit inserted into the inflow part and connected to the content inflow hole to discharge the content through pumping action due to elasticity, wherein the pumping unit further comprises:

a pumping member which is made of an elastic material so that the content is discharged through the pumping action including compression and expansion due to the elasticity and through which a content moving passage connected to the content inflow hole passes through an inside thereof;

a valve member provided in a lower portion of the pumping member to open a lower side of the content moving passage communicating with the content inflow hole; and a nozzle member inserted into an upper portion of the pumping member to open and close an upper side of the content moving passage while coming into contact and non-contact with the pumping member when the pumping member is elastically deformed, thereby discharging the content; and a pumping cap disposed below a button unit and coupled to the upper portion of the pumping member and having a discharge hole connected to a nozzle hole of the nozzle member at a center thereof;

wherein the pumping member further comprises:

an undercut part stepped so that a lower inner diameter thereof is more expanded than an upper inner diameter thereof on an inner circumferential surface of a nozzle insertion part, a valve mounting part inserted into and coupled to the content inflow hole of the shoulder unit and provided with the valve member therein;

an elastic pumping part extending upward from the valve mounting part and elastically deformed when pushing and pushing-releasing operation of the button unit are performed to perform pumping action for pumping the content within the pumping member upward;

the nozzle insertion part extends upward from the elastic pumping part and is coupled to a lower portion of the pumping cap and in which the nozzle member is inserted therein;

a bellows part having a bellow shape at a center in a longitudinal direction of the nozzle insertion part and compressed and expanded in a longitudinal direction of the nozzle insertion part when the pushing and pushing-releasing operation of the button unit are performed to perform elastic action;

wherein, in a state in which the nozzle member is inserted into the nozzle insertion part, a flange part protruding outward from a lower end of the nozzle member is closely attached to and supported by the undercut part, when the button unit is pushed downward, the bellows part is compressed downward by the pumping cap to allow the nozzle member to descend so that the close attachment of the flange part to the undercut part is released to open the undercut part and thereby to discharge the content, and when the button unit returns upward, the bellows part is expanded upward to allow the nozzle member to ascend so that the flange part is closely attached to the undercut part to seal the undercut part and thereby to block the discharge of the content; and the button unit elevatably coupled to an upper portion of the shoulder unit and connected to the pumping unit and an outlet hole, through which the content is discharged, at a center thereof, the button unit operating the pumping unit to discharge the content to the outlet hole by the pumping action of the pumping unit.

2. The case of claim 1, wherein the undercut part is provided as a stepped groove having an inner diameter corresponding to an outer diameter of the flange part on an inner circumferential surface of a connection portion between an upper end of the elastic pumping part and a lower end of the nozzle insertion part.

3. The case of claim 1, wherein the elastic pumping part is configured to connect the valve mounting part to the nozzle insertion part under the undercut part and has a tapered circular tube shape of which a diameter gradually decreases upward, and when the button unit is pushed downward to compress the bellows part downward, the elastic pumping part is elastically deformed inward in a radius direction of the pumping member to perform pumping for discharging the content within the pumping member upward through the opened undercut part.

4. The case of claim 1, wherein the bellows part serves as a spring while being elastically deformed through the compression and expansion in only the longitudinal direction of the pumping member without being elastically deformed to the inside and outside in the radius direction of the pumping member, and when a decompression vacuum test is performed on the case for the liquid state cosmetics, the undercut part is prevented from being opened by a pressure within the pumping member to prevent the content from leaking through the undercut part.

5. The case of claim 1, wherein the nozzle member comprises:

a nozzle body inserted into and coupled to a nozzle fixing tube protruding from a lower portion of the pumping cap and having a nozzle hole therein and a nozzle inflow hole connected to the nozzle hole to introduce the content into the nozzle hole in a side portion thereof;

an inflow guide piece radially protruding from an outer circumferential surface of the nozzle body to provide a content inflow path between the nozzle fixing tube and the nozzle body and thereby to guide the content into the nozzle inflow hole; and a flange part protruding in an annular shape from a lower end of the nozzle body, having an outer diameter corresponding to an inner diameter of the undercut part, and inserted into the nozzle insertion part so as to be closely attached to and supported by the undercut part.

6. The case of claim 5, wherein the pumping cap comprises:

a cap body provided in a hollow tube shape at a lower center of the button unit, inserted into and coupled to a button stem part fitted into the inflow part, and having a discharge hole connecting the nozzle hole of the nozzle body to the outlet hole of the button unit at a center thereof; and a nozzle fixing tube which protrudes from a lower portion of the cap body and are inserted into and coupled to the inside of an upper end of the pumping member and in which the nozzle body is inserted into and fixed.

7. The case of claim 6, wherein the pumping cap further comprises:

a decompression support extending to protrude downward from a lower portion of the cap body at a predetermined distance with respect to an outer circumferential surface of the nozzle fixing tube and supporting an outer circumferential surface of the nozzle insertion part inserted into and coupled to the outside of the nozzle fixing tube, wherein the decompression support supports the outside of the nozzle insertion part on which the undercut part is disposed when a decompression vacuum test is performed on the case for the liquid state cosmetics to prevent the undercut part from being opened by a pressure within the pumping member and thereby to prevent the content from leaking through the undercut part.

8. The case of claim 7, wherein the decompression support extends up to a connection portion between an upper end of the elastic pumping part and a lower end of the nozzle insertion part so as to be disposed corresponding to the undercut part.

9. The case of claim 1, wherein the valve member is integrated with the pumping member.

10. The case of claim 1, wherein the valve member comprises:

a check valve which extends to the inside of the valve mounting part to form an upward cone shape and in which a slit hole is defined in an upper end thereof so that the slit hole is spread or closed by a pressure to open and close the content moving passage, wherein, when the button unit is pushed downward, the slit hole is closed by the pressure within the pumping member to seal the check valve, and the bellows part is compressed downward after the check valve is sealed first to allow the nozzle member to descend so that the close attachment of the flange part to the undercut part is released to open the undercut part and thereby to discharge the content within the pumping member, and when the button unit returns upward, the bellows part is expanded upward to allow the nozzle member to ascend so that the flange part is closely attached to the undercut part to seal the undercut part and thereby to block the discharge of the content, and the slit hole is opened by the pressure within the case body after the undercut part is closed first to open the check valve and thereby to fill the content into the pumping member.

11. The case of claim 1, wherein the valve member comprises a disk valve in which a disk plate is disposed inside the valve mounting part, a plurality of valve holes are defined between elastic connection pieces connecting the disk plate to the valve mounting part, and the disk plate ascends and descends by elastic deformation of the elastic connection pieces to open and close the content moving passage within the valve mounting part, wherein, when the button unit is pushed downward, the disk plate descends by the pressure within the pumping member to seal the disk valve, and the bellows part is compressed downward after the disk valve is sealed first to allow the nozzle member to descend so that the close attachment of the flange part to the undercut part is released to open the undercut part and thereby to discharge the content within the pumping member, and when the button unit returns upward, the bellows part is expanded upward to allow the nozzle member to ascend so that the flange part is closely attached to the undercut part to seal the undercut part and thereby to block the discharge of the content, and the disk plate ascends by the pressure within the case body after the undercut part is closed first to open the disk valve and thereby to fill the content into the pumping member.

* * * * *